US010017284B2

(12) United States Patent
Testoni et al.

(10) Patent No.: US 10,017,284 B2
(45) Date of Patent: Jul. 10, 2018

(54) PACKING METHOD AND PACKING MACHINE FOR PRODUCING A SLIDE-OPEN PACKAGE OF TOBACCO ARTICLES WITH A HINGED LID

(71) Applicant: G.D SOCIETA' PER AZIONI, Bologna (IT)

(72) Inventors: Luca Testoni, Castelmaggiore (IT); Stefano Sarti, Bologna (IT); Marco Garganelli, Argelato (IT); Mattia Meccagni, Castel di Casio (IT); Michele Squarzoni, Ferrara (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 453 days.

(21) Appl. No.: 14/653,289

(22) PCT Filed: Dec. 23, 2013

(86) PCT No.: PCT/IB2013/061297
§ 371 (c)(1),
(2) Date: Jun. 18, 2015

(87) PCT Pub. No.: WO2014/097279
PCT Pub. Date: Jun. 26, 2014

(65) Prior Publication Data

US 2015/0336695 A1 Nov. 26, 2015

(30) Foreign Application Priority Data

Dec. 21, 2012 (IT) ..... BO2012A0703

(51) Int. Cl.
*B65B 19/20* (2006.01)
*B65B 19/22* (2006.01)
(Continued)

(52) U.S. Cl.
CPC ..... *B65B 19/20* (2013.01); *B65B 19/22* (2013.01); *B65B 19/223* (2013.01);
(Continued)

(58) Field of Classification Search
CPC ..... B65B 19/18; B65B 19/20; B65B 19/223; B65B 19/225; B65B 19/226;
(Continued)

(56) References Cited

U.S. PATENT DOCUMENTS 3,048,320 A * 8/1962 Hovland et al. ..... B65D 5/6688 206/250
3,933,299 A 1/1976 Shimada et al.
(Continued)

FOREIGN PATENT DOCUMENTS

CA 2802073 A1 * 12/2011 ..... B65B 19/223
EP 0900646 A1 3/1999
(Continued)

OTHER PUBLICATIONS

International Search Report and Written Opinion, International Application No. PCT/IB2013/061297, dated Apr. 7, 2014, 7 pages.
(Continued)

*Primary Examiner* — Stephen F Gerrity
(74) *Attorney, Agent, or Firm* — Marshall, Gerstein & Borun LLP

(57) ABSTRACT

A packing method and packing machine for producing a slide-open package of tobacco articles with a hinged lid can include obtaining a wrapped group of tobacco articles with a first packing unit; obtaining an inner container which houses the wrapped group of tobacco articles and has the hinged lid with a second packing unit by folding an inner blank about the wrapped group of tobacco articles; and obtaining an outer container which slidably houses the inner container inside and is provided with a connecting tab, that
(Continued)

at one end is integral with the outer container and at the other end is glued to the lid of the inner container, with a third packing unit by folding an outer blank about the inner container.

9 Claims, 22 Drawing Sheets

(51) Int. Cl.

| | |
|---|---|
| ***B65B 51/20*** | (2006.01) |
| ***B65D 85/10*** | (2006.01) |
| ***B65D 5/66*** | (2006.01) |
| ***B65B 51/02*** | (2006.01) |
| *B31B 50/62* | (2017.01) |

(52) U.S. Cl.
CPC ..... *B65B 19/228* (2013.01); *B65B 51/02* (2013.01); *B65D 5/6688* (2013.01); *B65D 85/1054* (2013.01); *B31B 50/62* (2017.08); *B31B 2241/003* (2013.01); *B65B 2230/04* (2013.01)

(58) Field of Classification Search
CPC . B65B 19/228; B65B 2230/04; B65D 5/6688; B65D 85/1054; B31B 2241/003
USPC ..... 53/444, 449, 148, 169, 170, 172; 206/250
See application file for complete search history.

(56) References Cited

U.S. PATENT DOCUMENTS

| | | | | | |
|---|---|---|---|---|---|
| 3,979,047 | A | | 9/1976 | Focke et al. | |
| 4,056,047 | A | * | 11/1977 | Grimm | B65D 85/1054 493/102 |
| 4,188,024 | A | | 2/1980 | Seragnoli | |
| 4,392,338 | A | | 7/1983 | Fox | |
| 4,487,596 | A | | 12/1984 | Livens et al. | |
| 4,646,960 | A | * | 3/1987 | Challand | B65D 85/1054 206/259 |
| 5,133,170 | A | | 7/1992 | Lewis et al. | |
| 5,193,328 | A | | 3/1993 | Boriani et al. | |
| 2011/0041463 | A1 | | 2/2011 | Squarzoni et al. | |
| 2014/0305080 | A1 | | 10/2014 | Squarzoni | |

FOREIGN PATENT DOCUMENTS

| | | | | | |
|---|---|---|---|---|---|
| EP | 2125573 | A1 | | 12/2009 | |
| EP | 2311632 | A1 | * | 4/2011 | B65B 19/20 |
| JP | 06156452 | A | * | 6/1994 | |
| WO | WO-2013/068951 | A1 | | 5/2013 | |

OTHER PUBLICATIONS

International Preliminary Report on Patentability, International Application No. PCT/IB2013/061297, dated Nov. 27, 2014, 4 pages.

* cited by examiner

PACKING METHOD AND PACKING MACHINE FOR PRODUCING A SLIDE-OPEN PACKAGE OF TOBACCO ARTICLES WITH A HINGED LID

CROSS-REFERENCE TO RELATED APPLICATIONS

This is the U.S. national phase of PCT/IB2013/061297, filed Dec. 23, 2013, which claims the benefit of Italian Patent Application No. BO2012A000703, filed Dec. 21, 2012.

TECHNICAL FIELD

The present invention relates to a packing method and to a packing machine for producing slide-open package of tobacco articles with a hinged lid.

PRIOR ART

The rigid packages of cigarettes with a hinged lid are currently the most widespread cigarette packages in the market as they are of simple construction, easy and practical to use and offer good mechanical protection to the cigarettes contained within.

Besides the aforementioned rigid packages of cigarettes with a hinged lid, packages of cigarettes have been proposed with rigid slide-open (or sliding) covers comprising two containers inserted one inside the other in a separable way. In other words, a package of cigarettes with rigid slide-opening comprises an inner container, which is adapted to accommodate a wrapped group of cigarettes in a wrapping sheet of metalized paper and is housed within an outer container so as to be able to slide with respect to the outer container itself between a closed configuration, wherein the inner container is inserted inside the outer container, and an open configuration, wherein the inner container is extracted from the outer container.

Also proposed was a rigid slide-open package of cigarettes and with a hinged lid, wherein the inner container (or, alternatively, the outer container) is provided with a hinged lid to rotate between a closed position and an open position of an open top end of the inner container. The lid has a connecting tab that at one end is integral with the lid and at the opposite end is integral with the outer container (or, alternatively, to the inner container) to control "automatically" (i.e. without the user having to touch the lid) the rotation of the lid by sliding the inner container with respect to the outer container.

In particular, in a rigid package of cigarettes of the slide opening type and with a hinged lid the connecting tab which "automatically" controls the rotation of the lid has a top end that is glued to a top or rear wall of the lid and a bottom end that is integral with a rear wall of the outer container (i.e. a seamless extension of the rear wall of the outer container).

It was observed that the known current mode used for producing the packages of cigarettes of the slide-opening type and with a hinged lid does not allow to achieve high productivity (i.e. a high number of packages of cigarettes produced per unit of time), especially if it is necessary to maintain a high quality standard. Consequently, the known packing machines used for producing packages of cigarette of the slide-open type and with a hinged lid are excessively slow and suitable to produce only-limited batches for special series.

Additionally, but not less important, the known packing machines used for producing packages of cigarettes of the slide-opening type and with a hinged lid are not "flexible", i.e. it is very complicated to modify a packing machine which produces a certain type of slide-opening cigarette package (with or without a hinged lid) to produce another type of slide-opening cigarette package (with or without a hinged lid).

The patent application US2011041463A1 describes a cigarette packing machine for producing a rigid package with hinged lid. The packing machine is provided with a first packing unit, which is adapted to fold a first blank about a group of cigarettes to form an outer container provided with a hinged lid, and a second packing unit, which is adapted to fold a second blank about the outer container to form a tubular slider arranged about the outer container to slide axially with respect to the outer container itself; the tubular slider is provided with a transmission member, which has a first end integral with the lid, a second end opposite to the first end and integral with the slider, and an intermediate portion which is deformable and has a "U" fold arranged between the outer container and the slider.

In patent application US2011041463A1, the transmission member is folded upon itself and is gummed (in correspondence of the first end that is destined to be glued to the lid) before coupling the second blank to the outer container; then, in a transfer station, the second blank provided with a transmission member folded and gummed is coupled to the outer container so as to rest the first end of the transmission to a rear wall of the lid of the outer container.

DESCRIPTION OF THE INVENTION

Purpose of the present invention is to provide a packing machine and a packing method for producing a package of tobacco articles of the type with a hinged lid, which machine and packing method are free from the drawbacks described above and, in particular, are simple and economical to produce.

According to the present invention a packing method and a packing machine for producing a package of tobacco articles of the slide-opening type and with hinged lid, as claimed in the appended claims are provided.

BRIEF DESCRIPTION OF THE DRAWINGS

The present invention will now be described with reference to the accompanying drawings, which illustrate a non-limiting embodiment, wherein.

PREFERRED EMBODIMENTS OF THE INVENTION

Figure 1:
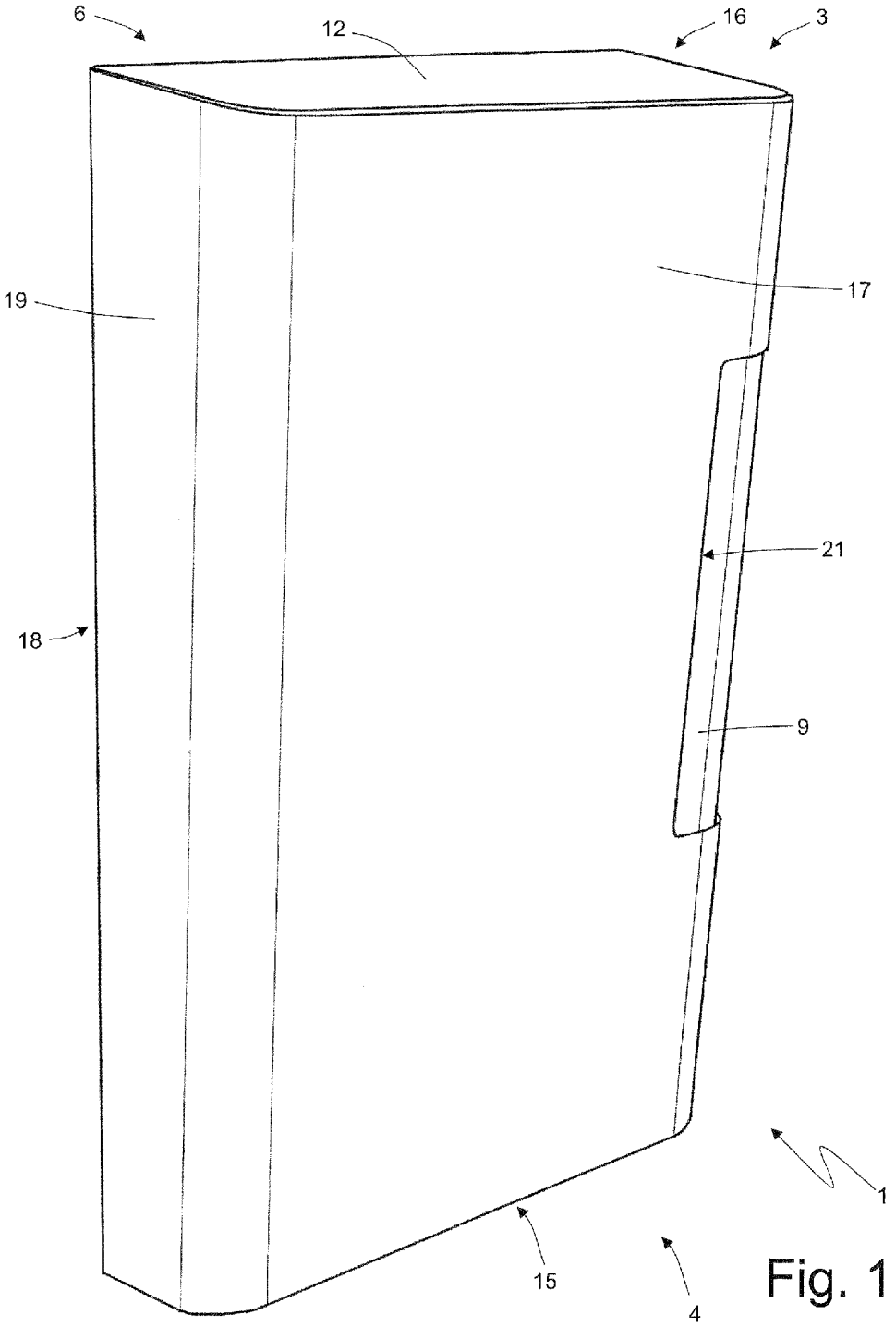
FIG. 1 is a front perspective view and in a closed configuration of a package of cigarettes of the rigid type with slide-opening and with a hinged lid.
Figure 2:
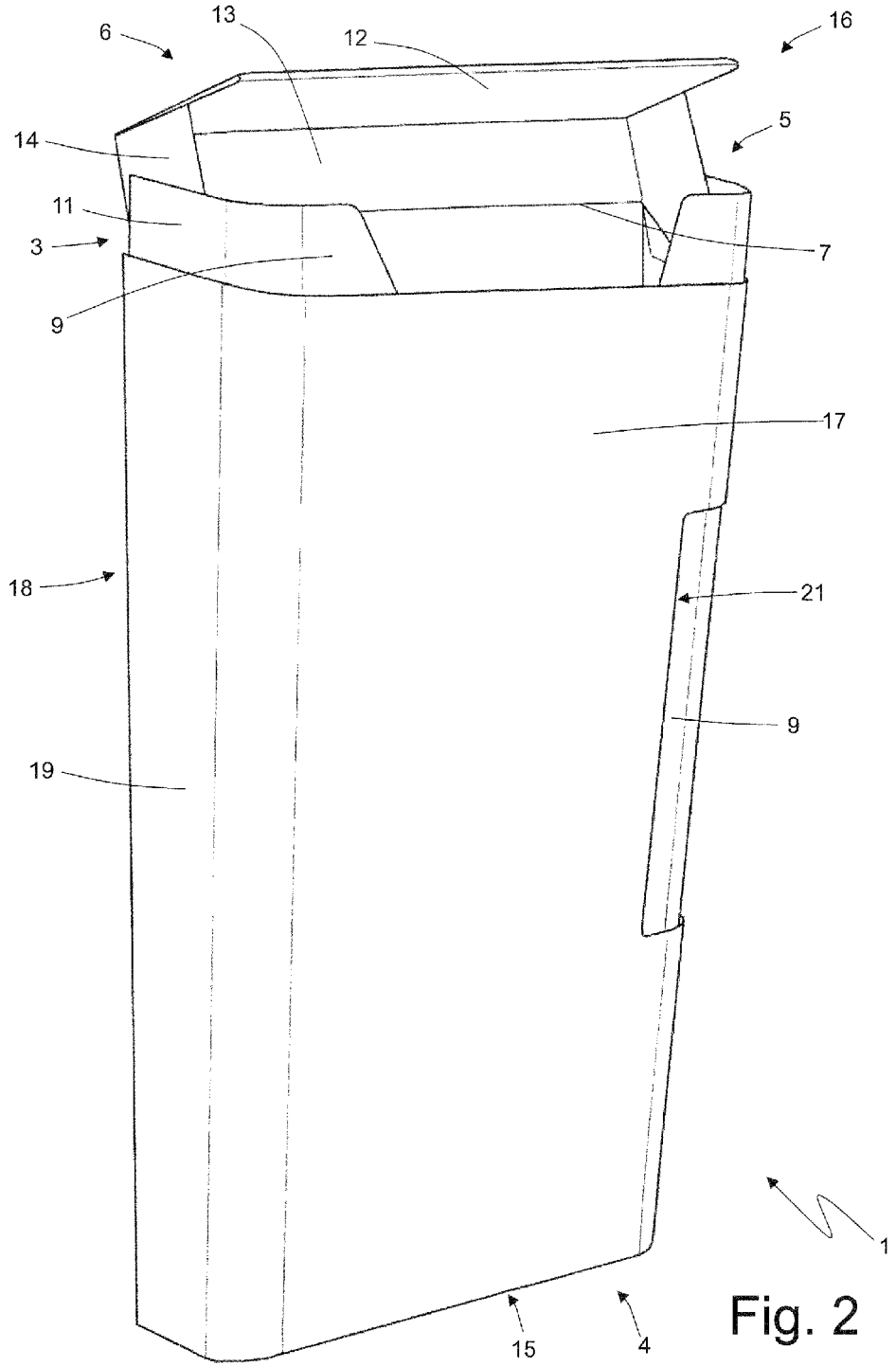
FIG. 2 is a front perspective view and in an open configuration of the package of cigarettes of FIG. 1.
Figure 3:
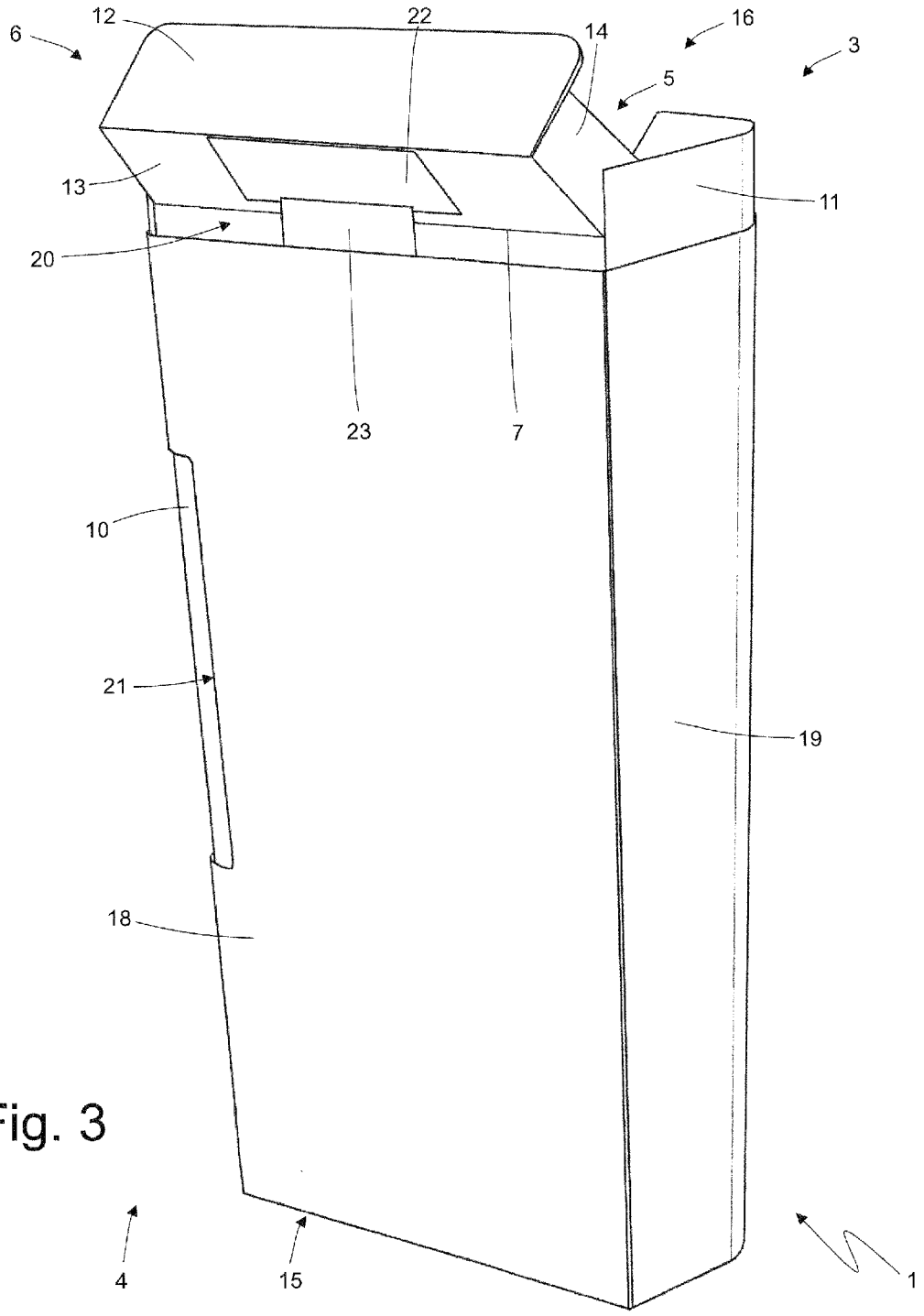
FIG. 3 is a rear perspective view and in an open configuration of the package of cigarettes of FIG. 1.

In FIGS. 1, 2 and 3, with the number 1 is indicated, as a whole, a rigid slide-open package of cigarettes by way of translation (linear movement).

The package 1 of cigarettes shown in FIG. 1 comprises a wrapped group 2 of cigarettes (visible schematically in FIG. 8), i.e. a group of cigarettes wrapped in a sheet of metalized wrapping paper. Also, the package 1 of cigarettes comprises an inner container 3 of the rigid type, inside of which the wrapped group 2 is directly placed, and an outer container 4 of the rigid type, which houses in a sliding manner the inner container 3 to allow the inner container 3 itself to slide with respect to the outer container 4 so as to move with a translational movement between a closed configuration (illustrated in FIG. 1), wherein the inner container 3 is fully inserted inside the outer container 4, and an open configuration (shown in FIGS. 2 and 3), wherein the inner container 3 is partially extracted from the outer container 4 and allows access to the wrapped group 2 of cigarettes.

The inner container 3 is parallelepiped-shaped with rectangular cross section, is cup-shaped and has an open upper end 5. The inner container 3 comprises a lid 6, which is cup-shaped and is hinged to the inner container 3 along a hinge 7 to rotate, with respect to the inner container 3 itself, between an open position (shown in FIGS. 2 and 3) and a closed position (shown in FIG. 1) of the open top end 5.

Figure 4:
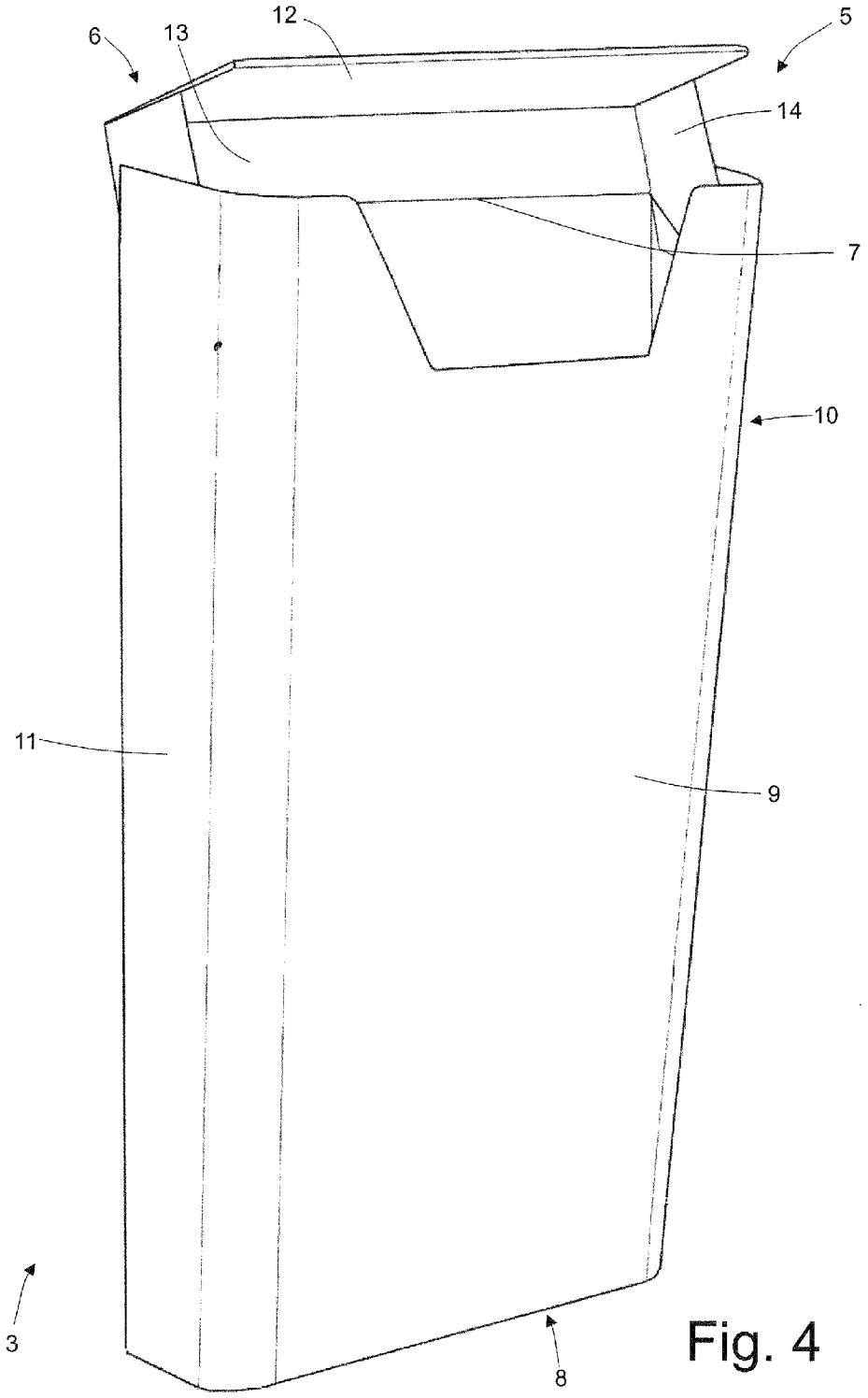
FIG. 4 is a front perspective view of an inner container of the package of cigarettes of FIG. 1.
Figure 5:
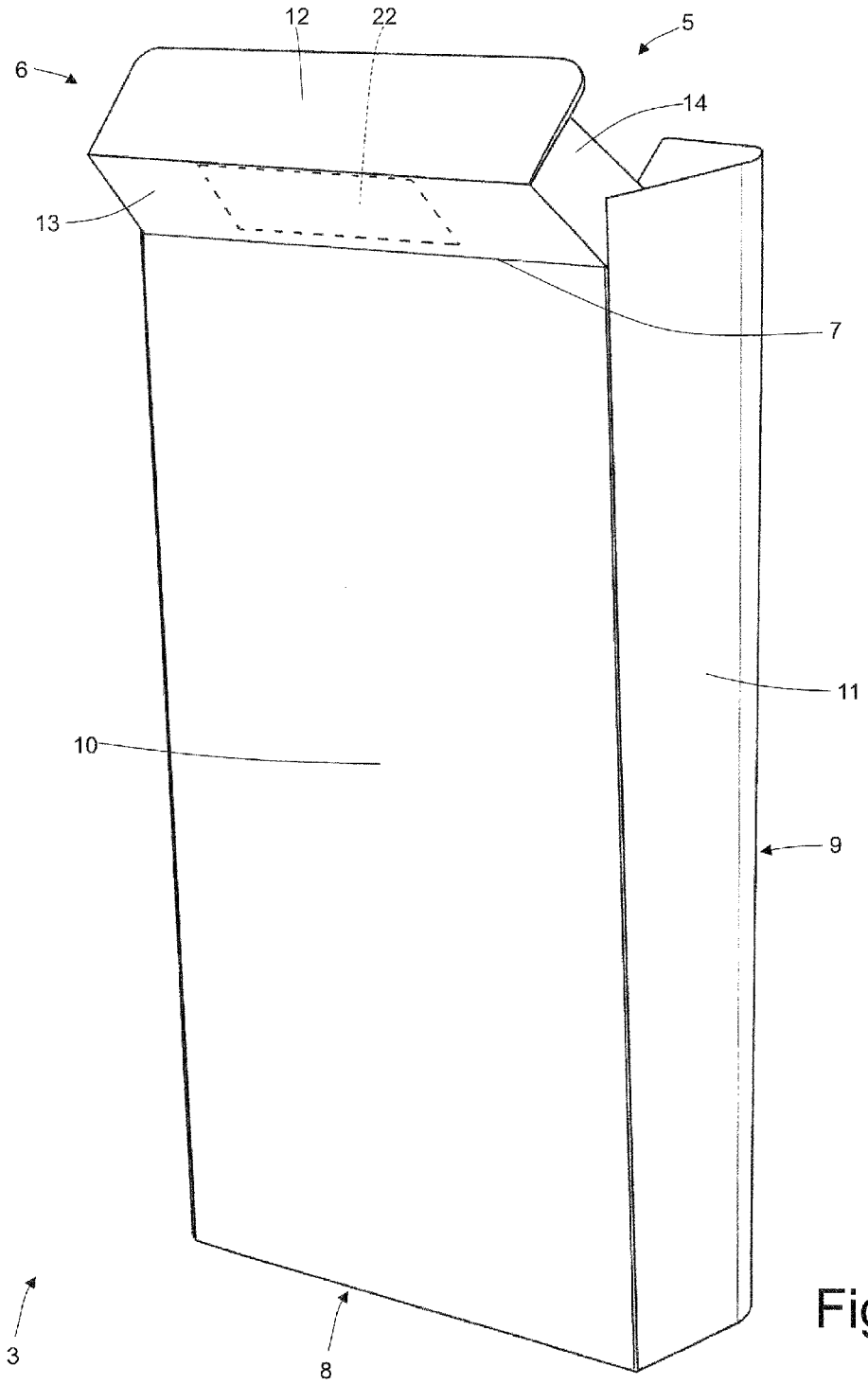
FIG. 5 is a rear perspective view of the inner container of FIG. 4.

As shown more clearly in FIGS. 4 and 5, the inner container 3 has a bottom wall 8 opposite to the open upper end 5, a front wall 9 and a rear wall 10 parallel and opposite one to the other, and two lateral walls 11 parallel to each other and interposed between the walls 9 and 10. Between the walls 9 and and the lateral walls 11 are defined four longitudinal edges while between the walls 9, 10 and 11 and the bottom wall 8 are defined four transverse edges.

The lid 6 is cup-shaped and has a top wall 12 (which, when the lid 6 is in the closed position, is opposite and parallel to the bottom wall 8 of the inner container 3), a rear wall 13 which is connected with the rear wall 10 of the inner container 3 by way of the hinge 7, and two lateral walls 14 parallel one to the other. It is important to note that the lateral walls 14 of the lid 6 are arranged inside the lateral walls 11 of the inner container 3 as is clearly illustrated in FIGS. 4 and 5.

As illustrated in FIGS. 1, 2, 3 and 6, the outer container 4 is cup-shaped, is of parallelepiped shape with rectangular cross section, and has a bottom wall 15 opposite to an open top end 16, a front wall 17 and a rear wall 18 opposite and parallel with respect to each other, and two lateral walls 19 parallel one to the other and interposed between the walls 17 and 18. Between the walls 17 and 18 and the lateral walls 19 four longitudinal edges are defined while between the walls 17, 18 and 19 and the bottom wall 15 four transverse edges are defined.

In the embodiment illustrated in the attached figures, all the transverse edges are straight, the rear longitudinal edges (i.e. arranged on opposite sides of the rear walls 10 and 18) are straight, and the front longitudinal edges (i.e. arranged on opposite sides of the front walls 9 and 17) are rounded. According to an alternative embodiment not illustrated, the front longitudinal edges are beveled instead of being rounded, or all edges (therefore including the front longitudinal edges) are straight.

As illustrated in FIG. 3, the rear wall 13 of the lid 6 (or in an alternative embodiment not shown, the top wall 12 of the lid 6) is connectable to the rear wall 18 of the outer container 4 by way of a connecting tab 20 to "automatically" control (i.e. without the user having to touch the lid 6) the rotation of the lid 6 by way of the sliding of the inner container 3 with respect to the outer container 4. In other words, thanks to the connecting tab 20 that mechanically couples the rear wall 13 of the lid 6 to the rear wall 18 of the outer container 4, when the inner container 3 slides with respect to the outer container 4 from the closed configuration to the open configuration, the lid 6 is pushed by the inner container 3 from the closed position to the open position in an "automatic" way (i.e. without the user having to touch the lid 6); similarly, when the inner container 3 slides with respect to the outer container 4 from the open configuration to the closed configuration, the lid 6 is pushed by the inner container 3 from the open position to the closed position in an "automatic" way (i.e. without the user having to touch the lid 6). In this way, the user only needs to apply the necessary thrust to slide the inner container 3 with respect to the outer container 4 without having to touch the lid 6 as its rotation is "automatically" controlled.

In the embodiment illustrated in the attached figures, the outer container 4 has a through window 21 that is formed astride the front wall 17, of a lateral wall 19 and of the rear wall 18 and through which an underlying lateral wall 11 of the inner container 3 is accessible to allow the application of a thrust to the inner container 3 in order to move the inner container 3 between the closed configuration and the open configuration.

As illustrated in FIG. 3, the connecting tab 20 comprises a top portion 22 that is glued (i.e. stably connected) to the rear wall 13 of the lid 6, and a bottom portion 23 that is connected to the top portion 22 along a pre-fold first fold line and is connected to a top edge of the rear wall 18 of the outer container 4 along a pre-fold second fold line. In other words, the connecting tab 20 is a seamless continuation of the rear wall 18 of the outer container 4. In addition to performing the connecting function between the rear wall 13 of the lid 6 and the rear wall 18 of the outer container 4, the connecting tab 20 also performs the end-of-stroke function since it limits the sliding of the inner container 3 with respect to the outer container 4; namely, the connecting tab defines a maximum opening position (i.e. of maximum extraction of the inner container 3 from the outer container 4 and therefore of maximum rotation of the lid 6 about the hinge 7) further blocking the sliding of the inner container 3 (and therefore the further rotation of the lid 6 about the hinge 7) once reaching the maximum opening position thereof.

Figure 6:
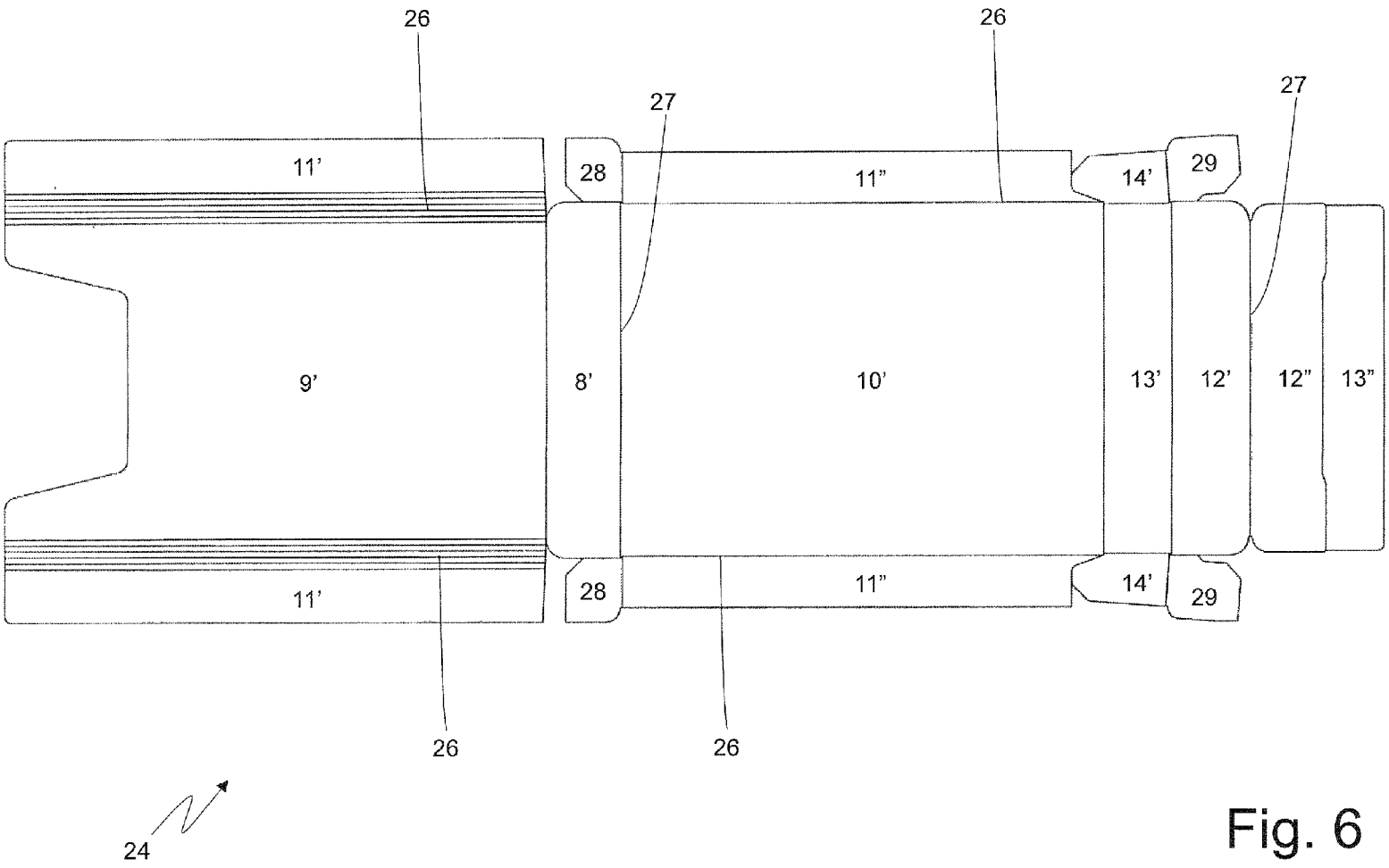
FIG. 6 is a plan view of an inner blank used for producing the inner container of FIG. 4.
Figure 7:
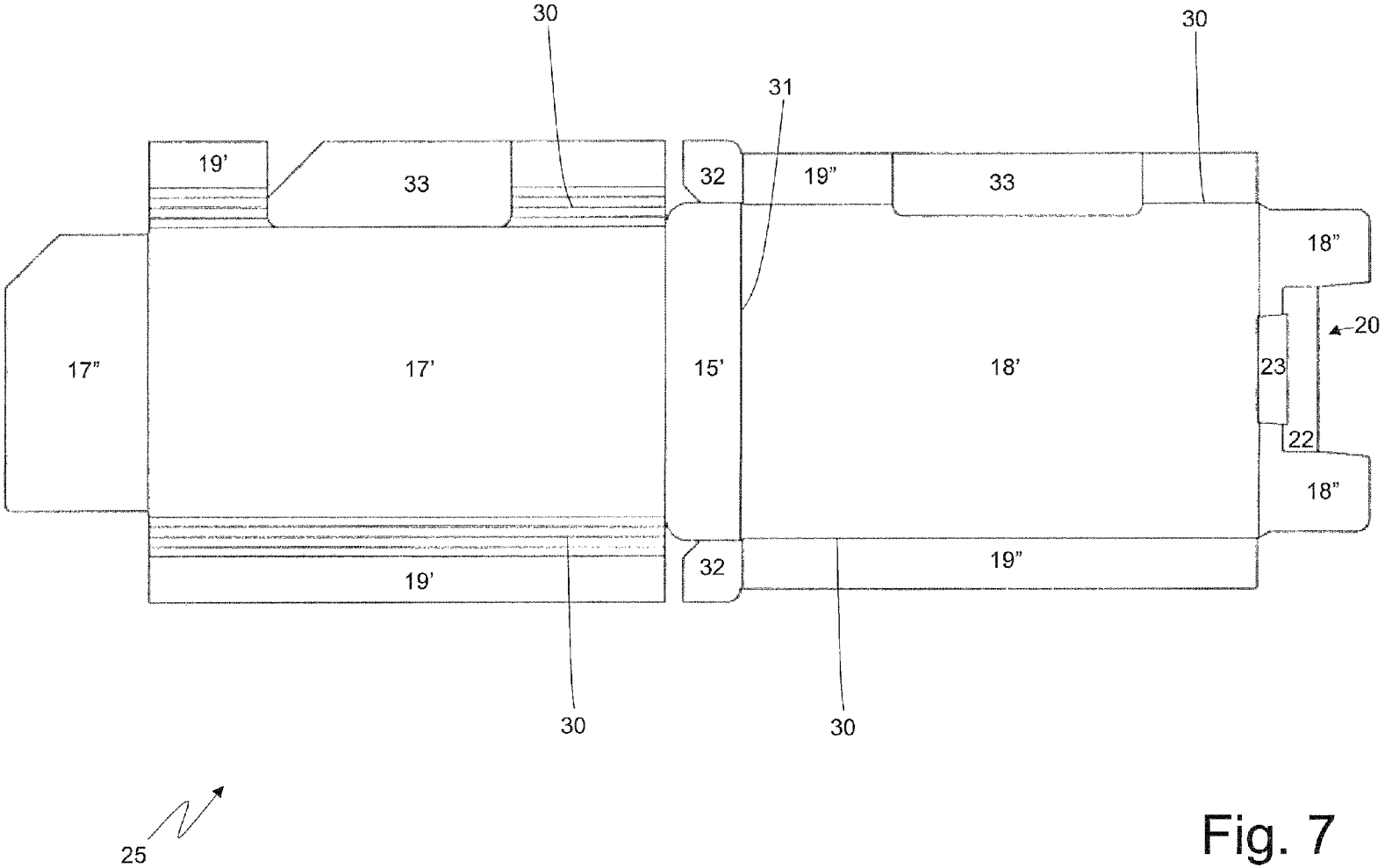
FIG. 7 is a plan view of an outer blank used to produce an outer container of the package of cigarettes of FIG. 1.

The containers 3 and 4 of the package 1 of cigarettes shown in FIGS. 1 to 5 are obtained from corresponding blanks 24 and, respectively, 25 illustrated in FIGS. 6 and 7. Each of the blanks 24 and 25 comprises, among other things, a number of elements, which will be marked, where possible, with accented reference numbers equal to the reference numbers as for the corresponding walls of the respective container 3 and 4.

With reference to FIG. 6, the inner blank 24 has two longitudinal fold lines 26 and a number of transverse fold lines 27, which define, between the two longitudinal fold lines 26, at least one panel 9' which forms the front wall 9 of the inner container 3; a panel 8' which forms the bottom wall 8 of the inner container 3, a panel 10' which forms the rear wall 10 of the inner container 3, a panel 13' which forms the rear wall 13 of the lid 6, a panel 12' which forms the top wall 12 of the lid 6, a reinforcing panel 12" which is glued to the inside of the panel 12', a reinforcing panel 13" which is glued to the inside of the panel 13'.

The panel 9' has two wings 11', which form an outer portion of the lateral walls 11 of the inner container 3, are arranged on opposite sides of the panel 9', and are connected to the panel 9' by longitudinal fold lines 26. Between the panel 9' and each wing 11' a number of longitudinal fold lines 26 that define a corresponding longitudinal front edge of a rounded shape are present. The panel 10' has two wings 11", which form an inner portion of the lateral walls 11 of the inner container 3, are arranged on opposite sides of the panel 10', and are connected to the panel 10' by longitudinal fold lines 26. The panel 13' has two wings 14' which form the lateral walls 14 of the lid 6, are arranged on opposite sides of the panel 13', and are connected to the panel 13' by longitudinal fold lines 26.

Each wing 11" has a tab 28 which is connected to the wing 11' by a transverse fold line 27, is folded by 90° with respect to the wing 11", and is glued to an inner surface of the panel 8'. Each wing 14' has a tab 29 that is connected to the wing 14' by a transverse fold line 27, is folded by 90° with respect to the wing 14', and is glued to an inner surface of the panel 12'.

With reference to FIG. 7, the outer blank 25 has two longitudinal fold lines 30 and a number of transverse fold lines 31, which define, between the two longitudinal fold lines 30, a reinforcing panel 17" that is glued to the inside of the panel 17', a panel 17' forming the front wall 17 of the outer container 4, a panel 15' forming the bottom wall 15 of the outer container 4, a panel 18' forming the rear wall 18 of the outer container 4, and a reinforcing panel 18" that is glued to the inside of the panel 18' and is "U" shaped having the connecting tab 20 at the center.

The panel 17' has two wings 19', which form an outer portion of the lateral walls 19 of the outer container 4, are arranged on opposite sides of the panel 17', and are connected to the panel 17' by longitudinal fold lines 30. Between the panel 17' and each wing 19' a number of longitudinal fold lines 30 that define a corresponding longitudinal front edge of rounded shape are present. The panel 18' has two wings 19", which form an inner portion of the lateral walls 19 of the outer container 4, are arranged on opposite sides of the panel 18', and are connected to the panel 18' by longitudinal fold lines 30.

Each wing 19" has a tab 32 which is connected to the wing 19' by a transverse fold line 31, is folded by 90° with respect to the wing 19", and is glued to an inner surface of the panel 15'.

In a wing 19' and in a corresponding wing 19" through "U" shaped openings are formed that are intended to form the window 21; in correspondence of said through-openings two respective reinforcing tabs 33 are arranged that are folded about a corresponding longitudinal fold line 30 by 180°, and respectively onto the panel 17' and onto the panel 18' to be glued respectively to the inside of the panel 17' and of the panel 18'.

Figure 8:
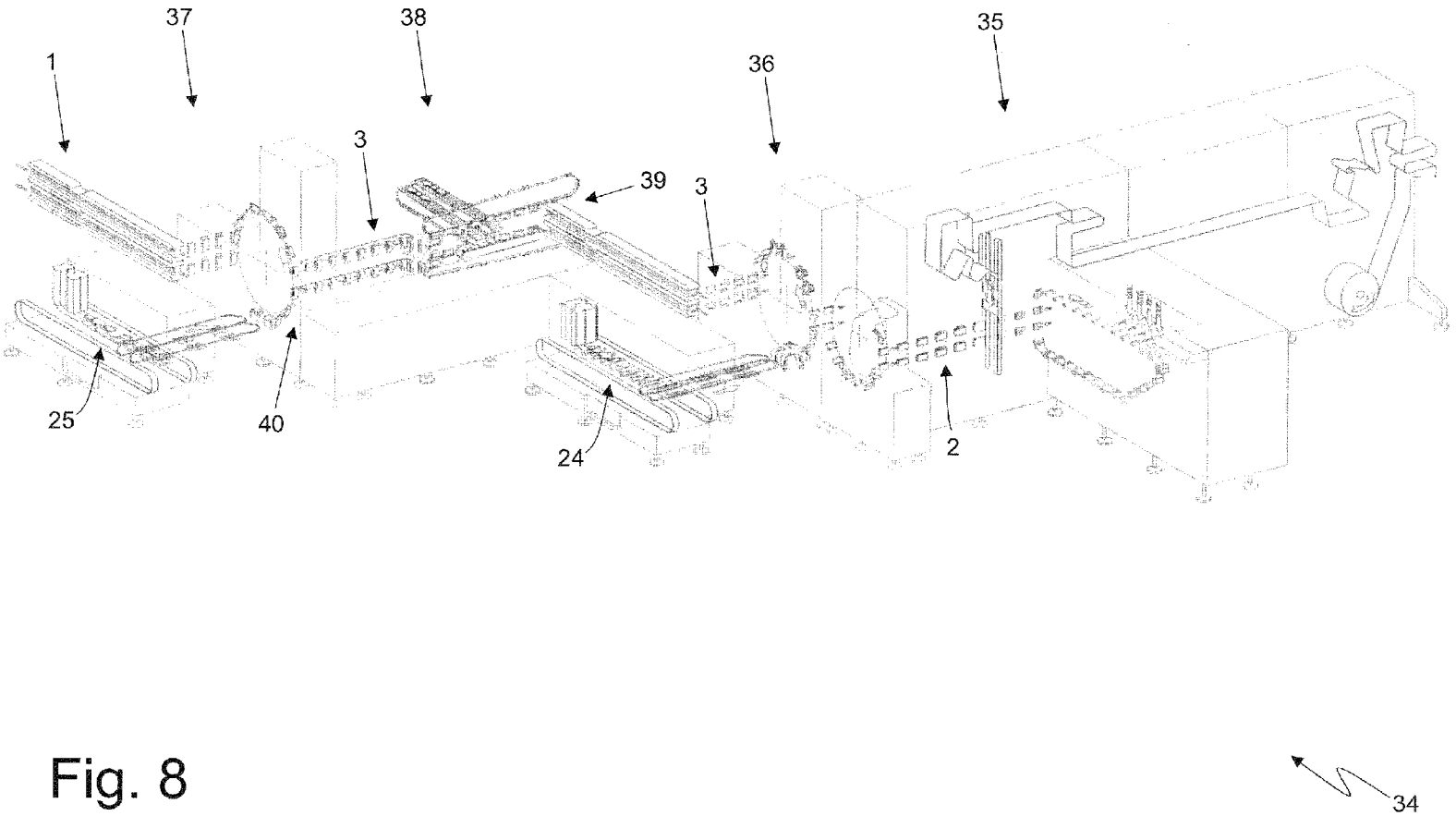
FIG. 8 is a schematic perspective view of a packing machine that produces the package of cigarettes of FIG. 1 and is made according to the present invention.

In FIG. 8 a cigarette packing machine 34 is illustrated that produces the packages 1 of cigarettes of the type described above and illustrated in FIGS. 1 to 3.

The packing machine 34 comprises a packing unit 35 that produces the wrapped groups 2 of cigarettes, a subsequent packing unit 36 that produces the inner containers 3 by folding the inner blanks 24 about corresponding wrapped groups 2 of cigarettes received by the packing unit 35, a packing unit 37 that produces the outer containers 4 by folding the outer blanks 25 about corresponding inner containers 3 received by the packing unit 36, and a transfer unit 38 which receives in input the inner containers 3 from the packing unit 36 in correspondence to an input station 39 and feeds in output the inner containers 3 to the packing unit 37 in correspondence to an output station 40.

Figure 9:
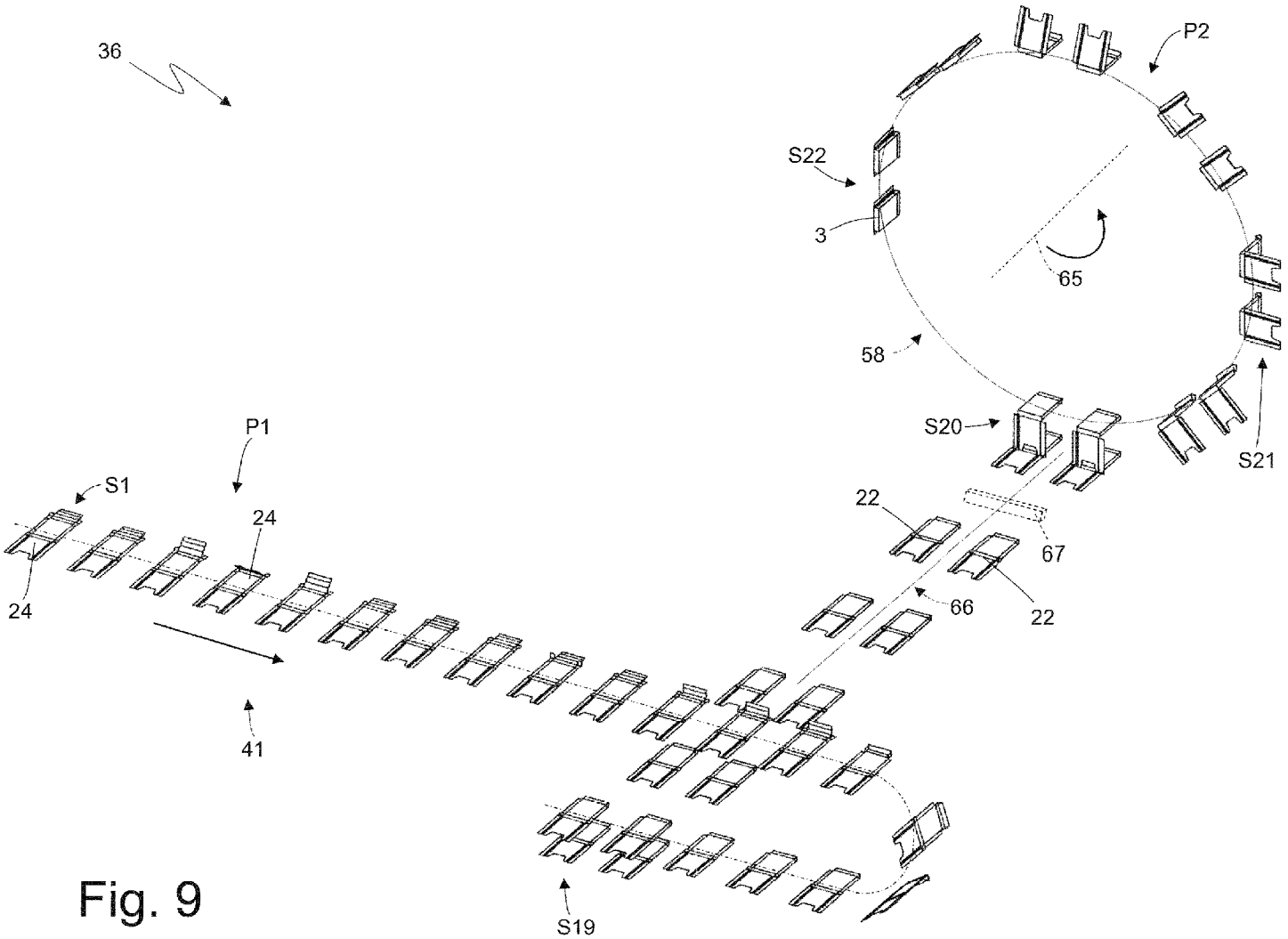
FIG. 9 is a schematic perspective view of a first packing unit of the packing machine of FIG. 8.
Figure 10:
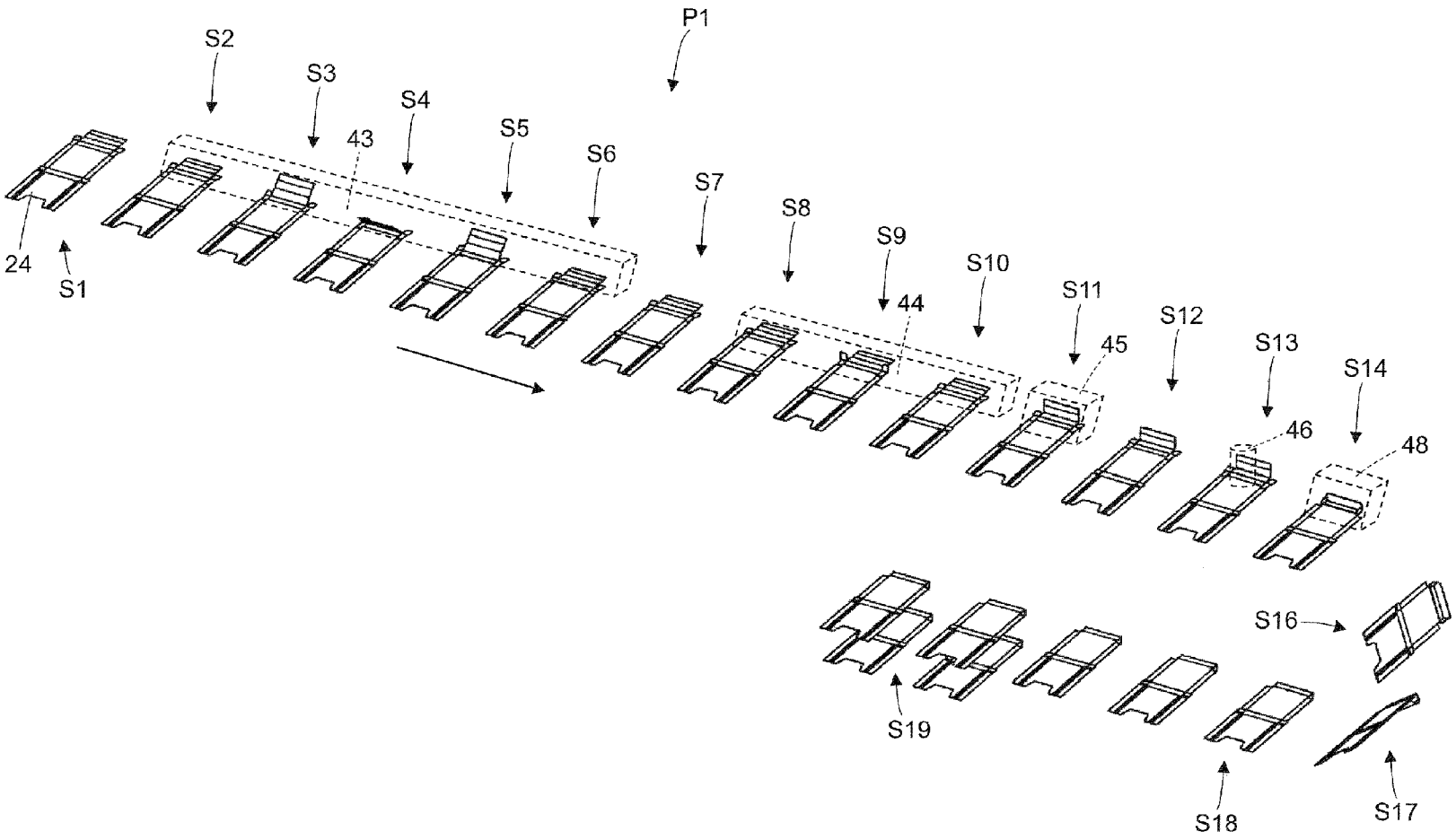
FIG. 10 is a schematic perspective view of a first packing conveyor of the first packing unit of FIG. 9.
Figure 11:
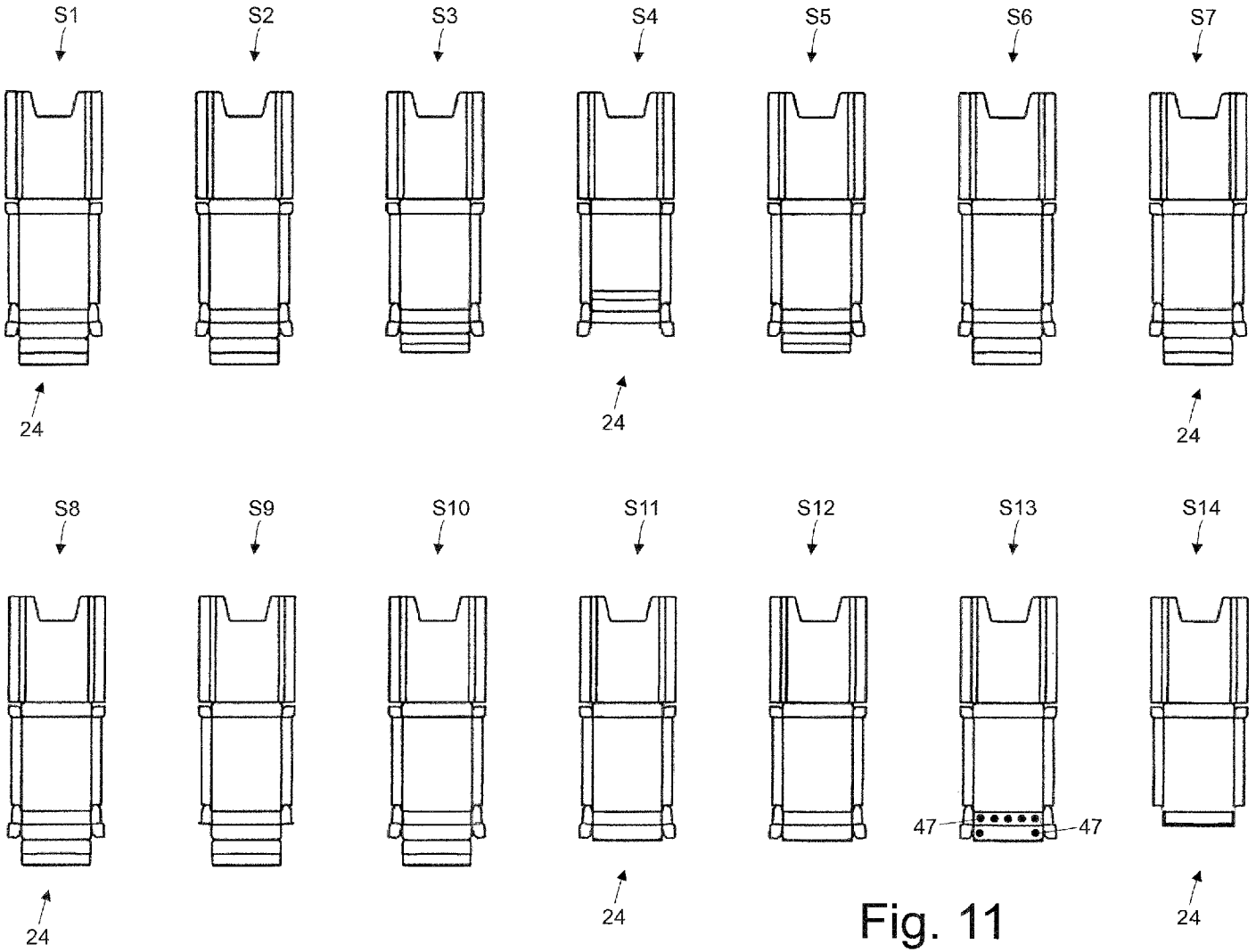
FIG. 11 is a plan view of a sequence of preliminary folding of the inner blank of FIG. 6 operated in the first packing conveyor of FIG. 10.

As illustrated in FIG. 9, the packing unit 36 comprises a packing conveyor 41 which is provided with a number of packing pockets 42 (shown in FIG. 14), each of which is adapted to house an inner blank 24 to feed the inner blank 24 by steps (i.e. with intermittent motion composed by a succession of motion steps intercalated with a corresponding succession of stopping steps) along a packing path P1 that extends between an input station S1 and an output station S19 through a succession of work stations from S2 to S18 (illustrated in FIGS. 10 and 11).

In correspondence to the input station S1, a hopper (not shown) is provided, which houses a stack of inner blanks 24 and cyclically feeds the inner blanks 24 from a bottom outlet towards the packing pockets 42 of the packing conveyor 41; in particular, each inner blank 24 arranged in correspondence to the bottom outlet of the hopper is picked up by a suction gripping head that moves vertically and is supported to an underlying packing pocket 42 of the packing conveyor 41 that stops and waits in the input station S1 in alignment with the bottom outlet.

It is important to note that the packing conveyor 41 feeds each inner blank 24 along the packing path P1 always transversely, i.e. always with the transverse fold lines 27 parallel to the feed direction; in other words, the packing conveyor 41 does not ever vary the orientation of each inner blank 24 with respect to the feed direction, and then in all the points of the packing path P1 each inner blank 24 has always its transverse fold lines 27 parallel to the feed direction (and thus its own longitudinal fold lines 26 perpendicular to the feed direction). Always maintaining a constant orientation of each inner blank 24 along the packing path P1 allows to simplify both the folding operations, and the structure of the packing conveyor 41.

Figure 14:
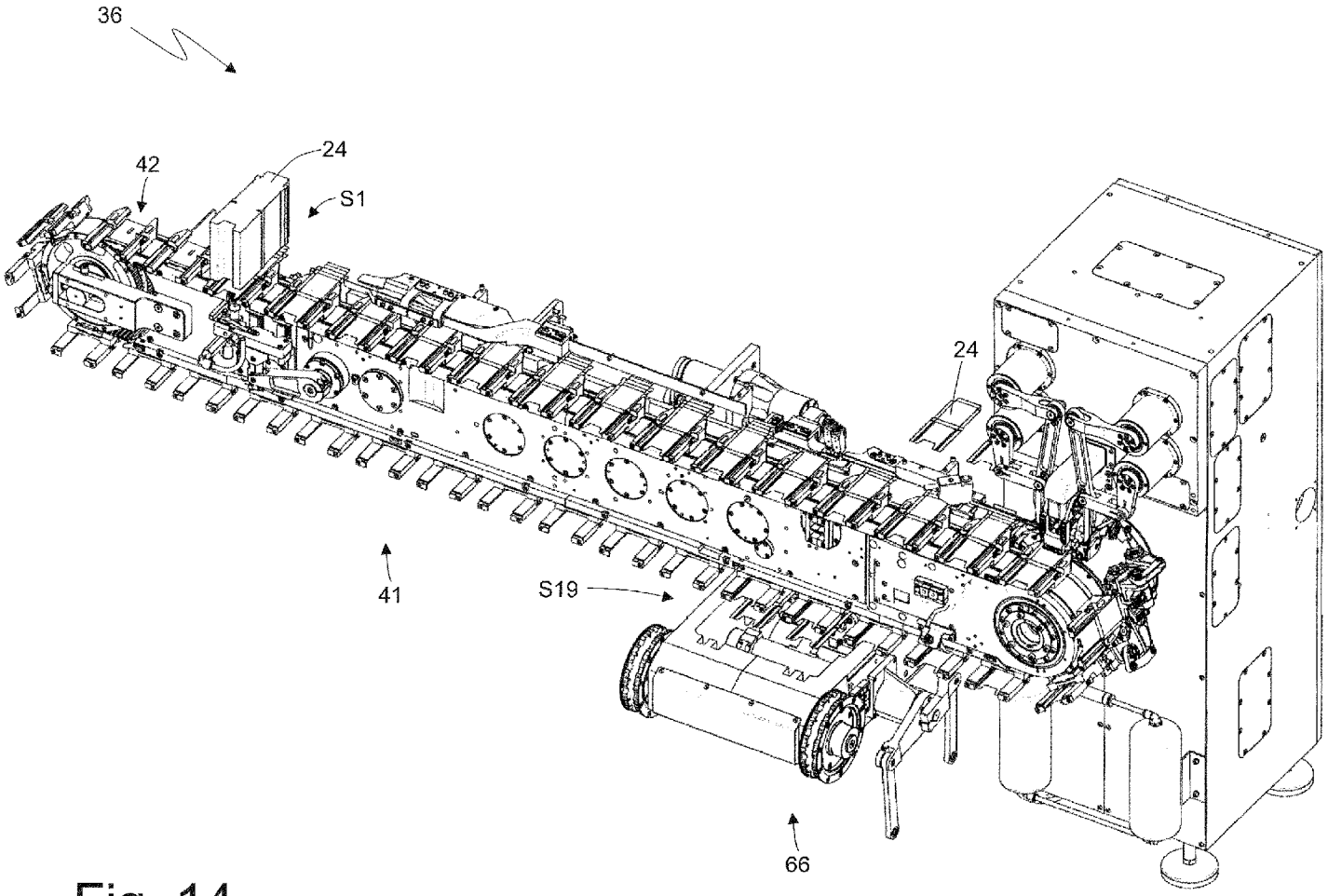
FIG. 14 is a perspective view and with the removal of parts for clarity of the first packing conveyor of FIG. 10.

According to a preferred embodiment shown in FIG. 14, the packing conveyor 41 is constituted by a conveyor belt that is wrapped about two end pulleys and supports a number of packing pockets 42; accordingly, the packing path P1 has an "U" shape and extends between the input station S1 arranged along a straight initial portion of the packing path P1 and the output station S19 arranged along a straight end portion of the packing path P1 which is connected to the straight initial portion by way of an intermediate semicircular portion.

As illustrated in FIG. 10, between the work station 52 and the work station S6 a folding device 43 is provided having fixed folding profiles (i.e. folding helixes that are devoid of movable parts and perform the folding operation while the inner blank 24 moves in the packing path P1 and thus exploiting the feeding movement of the inner blank 24); the folding device 43 folds the panel 12' by more than 90° (approximately by 140°-160°), with respect to panel 13', about a corresponding transverse fold line 27 in one direction and then in the opposite direction so that at the end of the folding device 43 the inner blank 24 is flat again. The folding device 43 performs two opposite folding operations (i.e. that cancel each other) having a flex function (i.e. weakening in order to considerably reduce the residual spring back force) the inner blank 24 along the corresponding transverse fold line 27. Therefore, the function of the folding device 43 is not performing an actual folding of the inner blank 24, but to prepare the inner blank 24 for the subsequent folding operations (described below).

Between the work station S8 and the work station S10 a folding device 44 is provided having fixed folding profiles (i.e. folding helixes that are devoid of movable parts and perform the folding operation while the inner blank 24 moves in the packing path P1 and thus exploiting the feeding movement of the inner blank 24); the folding device 44 folds the tabs 29 by 90°, with respect to the wings 14', about a corresponding transverse fold line 27 in one direction and then in the opposite direction so that at the end of the folding device 44 the blank 24 is flat again. The folding device 44 performs two opposite folding operations (i.e. that cancel each other) having a flex function (i.e. weakening in order to considerably reduce the residual spring back force) the inner blank 24 along the corresponding transverse fold line 27. Therefore, the function of the folding device 44 is not performing an actual folding of the inner blank 24, but to prepare the inner blank 24 for the subsequent folding operations (described below).

The above-described flexing of the inner blank 24 along the transverse fold line 27 which divides the panel 12' with respect to the panel 13' and the tabs 29 from the wings 14' is very useful to allow the proper formation of the lid 6 described in the following; i.e., without this flexing of the inner blank 24 the formation of the lid 6 described in the following can become problematic, and then determine a significant increase of defective inner containers 3 (due to a malformation of the lid 6) that must be discarded.

In the work station S11 a folding device 45 is provided having fixed folding profiles (i.e. folding helixes that are devoid of movable parts and perform the folding operation while the inner blank 24 moves in the packing path P1 and thus exploiting the feeding movement of the inner blank 24); the folding device 45 folds the panel 12" by 90°, with respect to the panel 12' and about a corresponding transverse fold line 27.

In the work station S13 a gumming device 46 (typically provided with nozzles that spray gumming glue) is provided which deposits glue points 47 (illustrated in FIG. 11) on the panel 12' and on the panel 13'.

In the work station S14 a folding device 48 is provided having movable parts (i.e. parts that move to perform the folding operation while the inner blank 24 is stopped waiting in the work station S14); the folding device 48 folds the tabs 29 by 90°, with respect to the wings 14' and about a corresponding transverse fold line 27, folds of the wings 14' by 90°, with respect to the panel 13' and about corresponding longitudinal fold lines 26, folds the panel 12' by 90°, with respect to the panel 13' and about a corresponding transverse fold line 27 (bringing the panel 12' onto the tabs 29 to which is glued by the effect of the glue 47).

Between the work station S14 and the work station S17 a folding device 54 is provided having movable parts (i.e. parts that move to perform the folding operation while the inner blank 24 moves along the packing path P1 through the work station from S14 to S17); the folding device 54 folds by further 90° (for a total of 180°) the panel 12" with respect to the panel 12' and about a corresponding transverse fold line 27 (bringing the panel 12" onto the panel 12'), and folds the panel 13" by 90° with respect to the panel 12' and about a corresponding transverse fold line 27 (bringing the panel 13" onto the panel 13' to which is glued by the effect of the glue 47).

Figure 12:
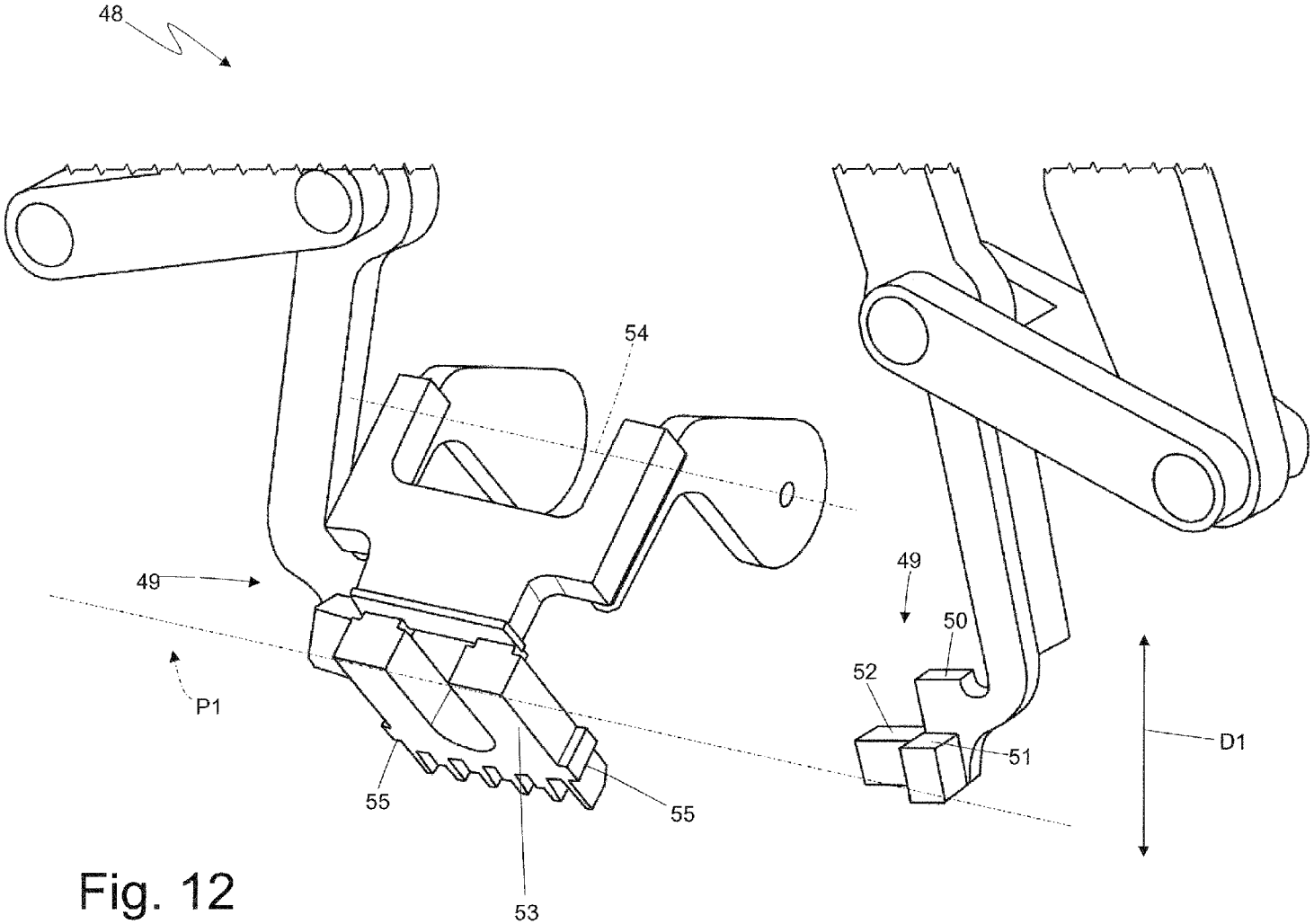
FIGS. 12 and 13 are two different perspective and schematic views of two folding bodies of a same folding device associated with the first packing conveyor.
Figure 13:
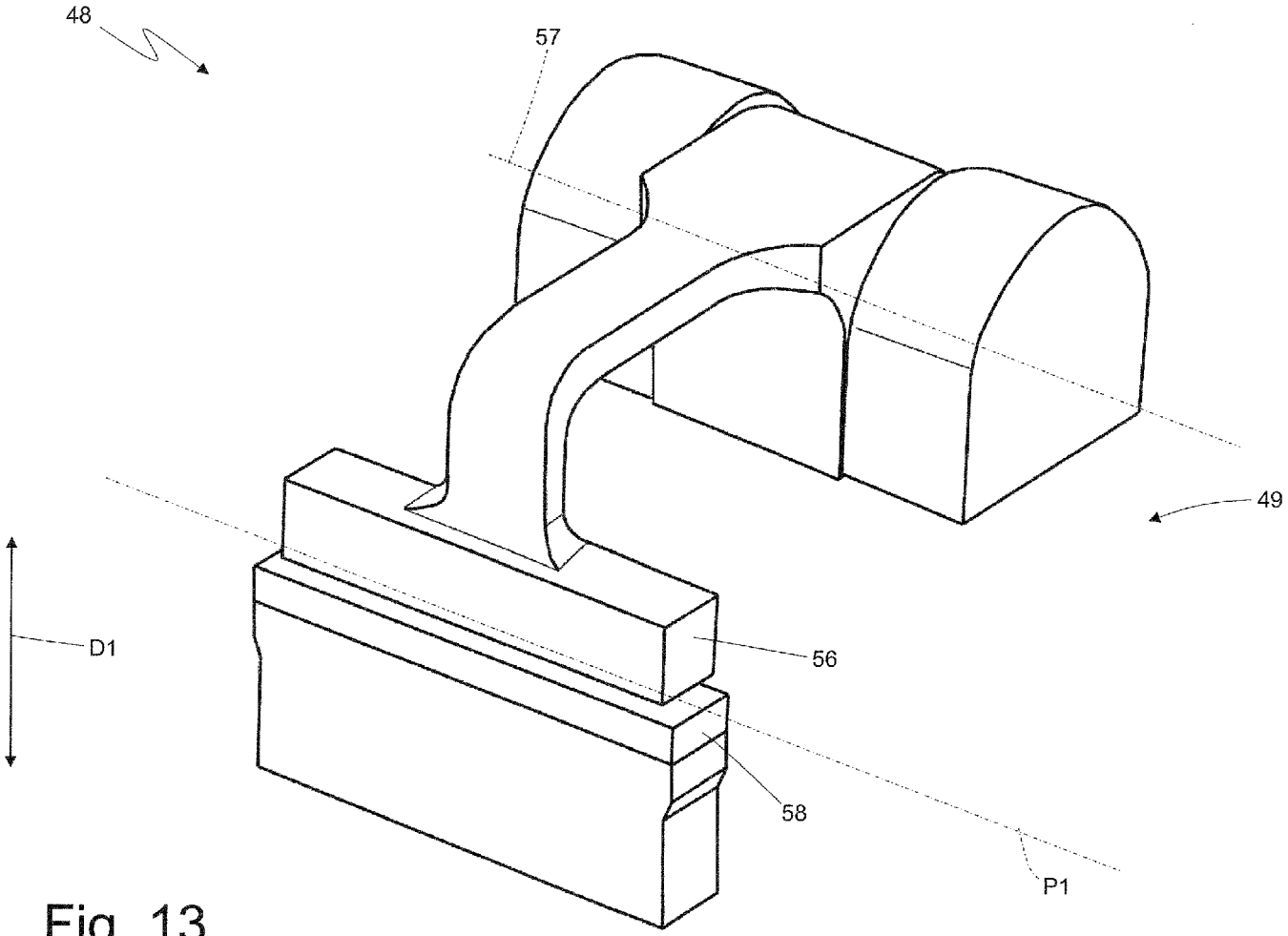

As illustrated in FIGS. 12 and 13, the folding device 48 comprises two folding twin bodies 49 (shown in FIG. 12) which are arranged on opposite sides of the inner blank 24 and are movable, close to the inner blank 24, along a vertical work direction D1 that is perpendicular to the packing path P1; in particular, the two folding bodies 49 are moved by the corresponding pentalateral articulated elements (partially illustrated in FIG. 12) operated by two cams. Each folding body 49 has a top member 50, an intermediate member 51, and a bottom member. 52 which are arranged in vertical positions (i.e. along the vertical work direction D1) differentiated to perform in succession respective folds (detailed below). Furthermore, the folding device 48 comprises a contrast member (shown in FIG. 12) that is mounted in a rotary way to rotate about an axis A1 of rotation parallel to the packing path P1 and has two lateral appendixes 55.

As illustrated in FIGS. 10 and 13, the folding device 54 comprises a series of folding members 56 (only one of which is shown in FIG. 13), each of which is mounted in a rotary way to rotate about an axis A2 of rotation parallel to the packing path P1 between the work station from S14 to S17 and is coupled to a corresponding pad 57 which is arranged on the opposite side of the inner blank 24.

The folding device 48 comprises two twin folding bodies 49 that are stably mounted at the work station S14 as the corresponding articulated pentalateral elements are hinged to a fixed frame of the packing machine 34. Instead, the folding device 54 comprises six folding members 56 (and of course the six corresponding pads 57) which are mounted on an end pulley of the packing conveyor 41 to rotate integrally with the end pulley, about a center axis A3 of rotation perpendicular to the packing path P1. In this way, each folding member 56 (together with the corresponding pad 57) engages an inner blank 24 in the work station S14 and accompanies the inner blank 24 itself for a certain segment of the packing path P1 until the work station S17.

In use, when the inner blank 24 stops at the work station S14, the two folding bodies 49 are arranged below the inner blank and are then moved from the bottom upwards along the vertical work direction D1 with a continuous movement so that initially the top members 50 of the two folding bodies 49 fold the tabs 29 by 90°, with respect to the wings 14' and about corresponding transverse fold line 27, then the intermediate members 51 of the two folding bodies 49 fold the wings 14' by 90°, with respect to the panel 13' and about corresponding longitudinal fold lines 26, and finally the bottom members 52 of the two folding bodies 49 fold the panel 12' with respect to the panel 13' and about a corresponding transverse fold line 27 (bringing the panel 12' onto the tabs 29 to which is glued by the effect of the glue 47). It is important to note that the members 50, 51 and 52 of the two folding bodies 49 are arranged at different heights along the vertical work direction D1 and therefore their action is staggered over time as the two folding bodies 49 are raising from the bottom upwards along the vertical work direction D1.

Initially, when the inner blank 24 stops at the work station S14, the contrast member 53, rotating about the axis A1 of rotation, rests on the panel 10', on the panel 13' and on the panel 12' so that their own lateral appendixes 55 rest on the wings 14'; in this way, the lateral appendixes 55 provide a contrast for the folding of the tabs 29 carried out by the top members 50 of the two folding bodies 49. Once the folding of the tabs 29 is finished, the contrast member 53, rotating about the axis A1 of rotation, moves slightly backwards setting free the wings 14' (i.e. removing the lateral appendixes 55 from the wings 14') to allow the subsequent folding of the wings 14' performed by the intermediate members 51 of the two folding bodies 49; in this step the contrast member 53 is still resting on the panel 13' to provide a contrast for both the folding of the wings 14' performed by the intermediate members 51 of the two folding bodies 49 and both for the subsequent folding of the panel 12' with respect to the panel 13' performed by the bottom members 52 of the two folding bodies 49. Once the folding of the panel 12' with respect to panel 13' performed by the bottom members 52 of the two folding bodies 49 is finished, the contrast member 53, rotating about the axis A1 of rotation, moves away from the inner blank 24.

While the contrast member 53 moves away from the inner blank 24, the folding member 56, rotating about the axis A2 of rotation, rests on, the inner blank 24 further determining the simultaneous folding of the panel 12" by 90°, with respect to the panel 12' (bringing the panel 12" onto the panel 12') and the folding of the panel 13" by 90°, with respect to the panel 12" (bringing the panel 13" onto the panel 13' to which is glued by the effect of the glue 47). In the final position, the folding member 56 rests on the panel 13" (which is superposed to the panel 13') and clamps, together with the underlying pad 57, the panels 13" and 13'. In other words, in the final position, the two panels 13" and 13' are clamped (i.e. compressed) between the folding member 56 and the underlying pad 57. This clamping is not confined in the work station S14, but continues through the work stations S15 and S16 to finish only in the work station S17; in this way an optimal gluing between the two panels 13" and 13' by the glue 47 can be ensured.

As illustrated in FIG. 9, the packing unit 36 comprises a packing conveyor 58 which is provided with a number of packing pockets 59 (illustrated schematically in FIG. 15), each of which is adapted to house an inner blank 24 and the corresponding wrapped group 2 of cigarettes for feeding the inner blank 24 and the wrapped group 2 of cigarettes along a packing path P2 that extends between an input station S20 and an output station S22.

At the input station S20, an inner blank 24 partially pre-folded and coming from the packing conveyor 41 is fed into a packing pocket 59 causing a further folding of the inner blank 24 itself. In correspondence to a feed station S21 arranged between the input station S20 and the output station S22, a wrapped group 2 of cigarettes is fed inside a packing pocket 59 to be coupled to the previously fed inner blank 24; in particular in the feed station S21 a rear wall of the wrapped group 2 of cigarettes rests on the panel 10' of the inner blank 24. At the output station S22, the inner container 3 (formed by folding the inner blank 24 about the wrapped group 2 of cigarettes) is extracted from the packing pocket 59 and proceeds towards the packing unit 37.

Figure 15:
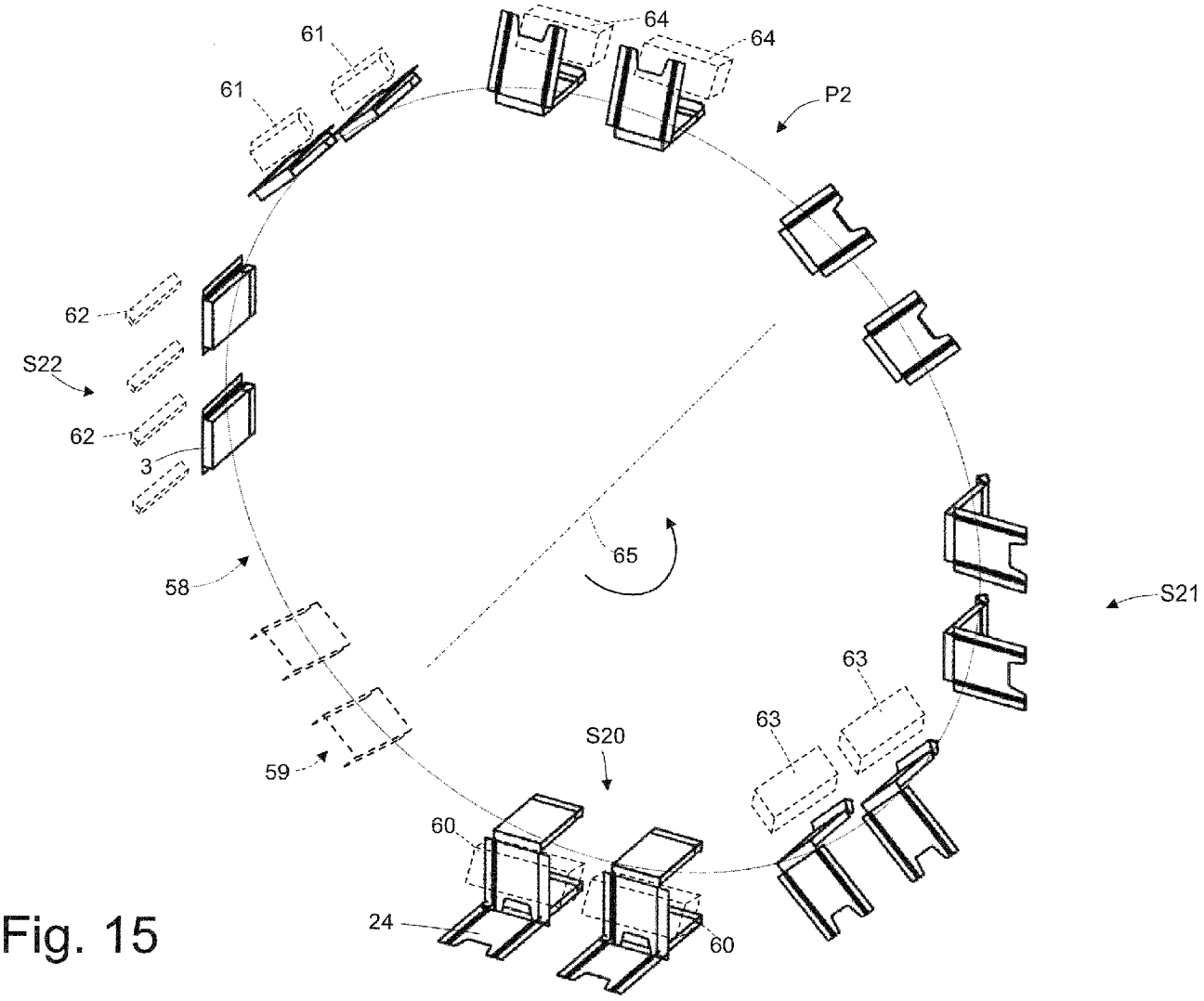
FIG. 15 is a schematic perspective view of a second packing conveyor of the first packing unit of FIG. 9.

As illustrated in FIG. 15, in the input station S20 a folding device 60 is arranged, which folds the tabs 28 of the inner blank 24 by 90°, with respect to the wings 11", and then, by inserting the inner blank 24 into the packing pocket 59, determines the folding of the panel 8' by 90°, with respect to the panel 10' and the folding of the two wings 11" by 90°, with respect to the panel 10'; in other words, after the folding of the tabs 28 by 90°, the input of the inner blank 24 in the packing pocket 59 determines the folding of the panel 8' by 90°, and of the two wings 11" by 90°, with respect to the panel 10' and in this way the tabs 28 rest on the panel 8'.

Between the feed station S21 and the output station S22 a folding device 96 is arranged, which folds the panel 9' by 90°, with respect to the panel 8', and about a corresponding transverse fold line 27. The folding of the inner blank 24 is completed in the output station S22 simultaneously with the extraction of the inner container 3 from the packing pocket 59: during the extraction of the inner container 3 from the packing pocket 59 a folding device 62 folds the wings 11' by 90°, with respect to the panel 9', onto the wings 11" and about corresponding longitudinal fold lines 26 completing the formation of the lateral walls 11 of the inner container 3; preferably, a gumming device (not shown) is arranged immediately upstream from the folding device 62 for depositing glue between the wings 11' and 11" immediately before folding the wings 11'. Downstream from the output station S22 a drying conveyor (shown schematically in FIG. 8) is arranged which transfers the inner containers 3 towards the packing unit 37.

According to a preferred embodiment shown in FIG. 15, upstream from the feed station S21 an opening device 63 is arranged that by rotating the lid 6 of each inner blank 24 about the corresponding hinge 7 moves the lid 6 from the closing position to the opening position so that in the feed station S21 the respective wrapped group 2 of cigarettes can be inserted more easily into the inner blank 24; in particular, in the feed station S21 the wrapped group 2 of cigarettes can be inserted with a substantially axial (i.e. longitudinal) movement into the inner blank 24. Consequently, downstream from the feed station S21 a closing device 64 is arranged that by rotating the lid 6 of each inner blank 24 about the corresponding hinge 7 moves the lid 6 from the open position to the closed position before continuing folding the inner blank 24.

According to a preferred embodiment illustrated in the attached figures, the packing conveyor 58 is constituted by a rotating wheel which rotates by steps about a central axis of rotation 65 arranged horizontally. Consequently, the packing path P2 that extends from the input station S20 to the output station S22 has a circular shape.

As illustrated in FIG. 9, the packing unit 36 comprises a transfer conveyor 66 which transfers the pre-folded inner blanks 24 from the output station S19 of the packing conveyor 41 to the input station S20 of the packing conveyor 58. Along the transfer conveyor 66 and upstream from the input station S20 of the packing conveyor 58 a gumming device 67 that deposits glue between the tabs 28 and the panel 8' of the inner blank 24 is arranged.

According to a preferred embodiment, one inner blank 24 at a time is fed to the packing conveyor 41 in the input station S1 of the packing path P1, and the transfer conveyor 66 transfers two inner blanks 24 at a time from the packing conveyor 41 to the packing conveyor 58; in this embodiment, the packing conveyor 58 at each step treats two inner blanks 24 at a time. According to an alternative embodiment not illustrated, two inner blanks 24 at a time are fed to the packing conveyor 41 in the input station S1 of the packing path P1.

Figure 16:
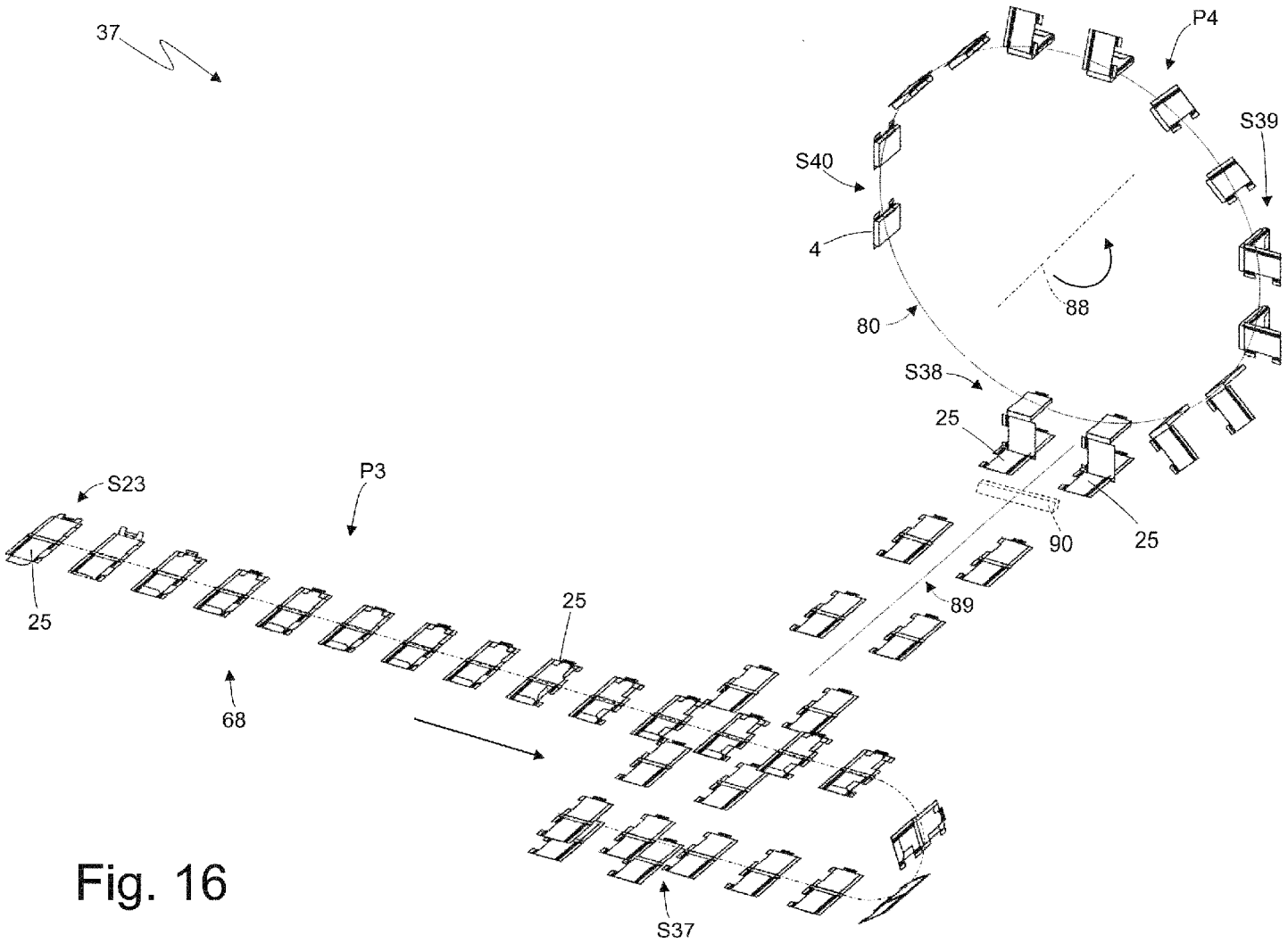
FIG. 16 is a schematic perspective view of a second packing unit of the packing machine of FIG. 8.
Figure 17:
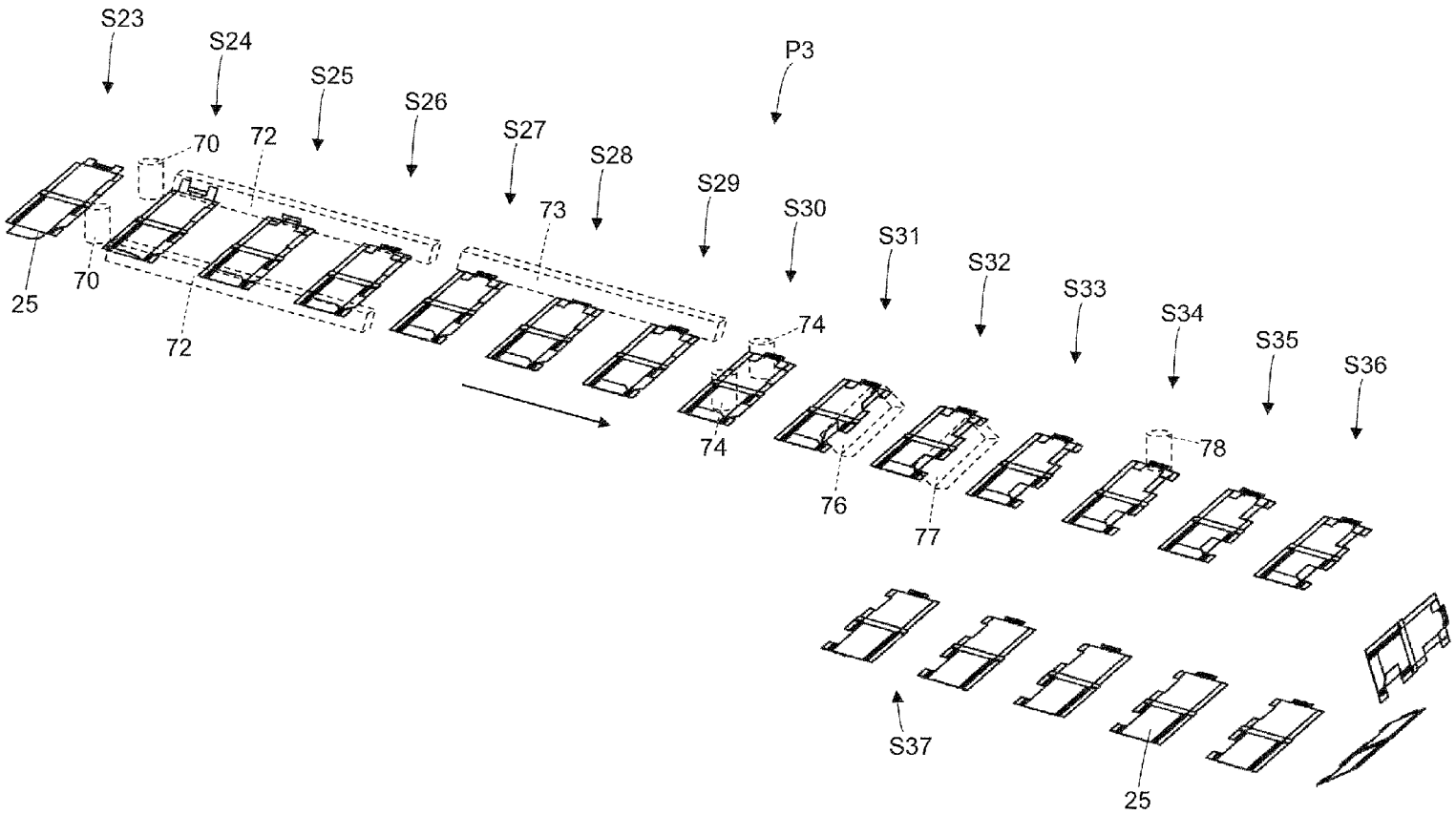
FIG. 17 is a schematic perspective view of a first packing conveyor of the second packing unit of FIG. 16.
Figure 18:
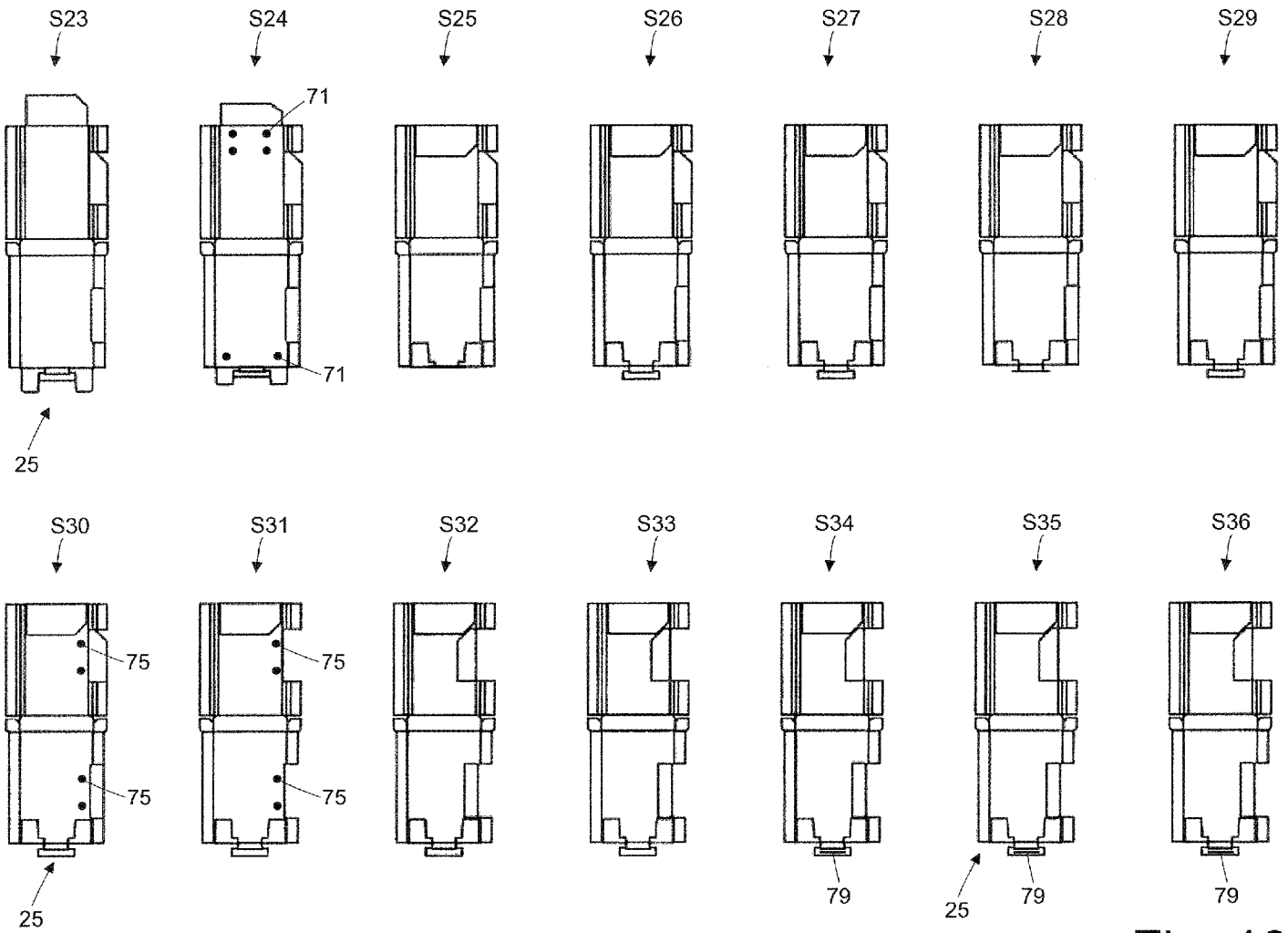
FIG. 18 is a plan view of a sequence of preliminary folding of the outer blank of FIG. 7 operated in the first packing conveyor of FIG. 17.

As illustrated in FIG. 16, the packing unit 37 comprises a packing conveyor 68 that is provided with a number of packing pockets 69 (illustrated in FIG. 19), each of which is adapted to house an outer blank 25 to feed the outer blank 25 by steps (i.e. with intermittent motion composed by a succession of motion phases intercalated with a corresponding succession of stop phases) along a packing path P3 that extends between an input station S23 and an output station S37 through a succession of work stations from S24 to S36 (illustrated in FIGS. 17 and 18).

At the input station S23, a hopper (not shown) is provided, which houses a stack of outer blanks 25 and cyclically feeds the outer blanks 25 from a bottom outlet towards the packing pockets 69 of the packing conveyor 68; in particular, each outer blank 25 arranged at the bottom outlet of the hopper is picked up by a suction gripping head that moves vertically and rests on an underlying packing pocket 69 of the packing conveyor 68 that is stopped waiting in the input station S23 in alignment with the bottom output.

It is important to note that the packing conveyor 68 advances each outer blank 25 along the packing path P3 always transversely, or always with the transverse fold lines 31 parallel to the feed direction, in other words, the packing conveyor 68 does not ever vary the orientation of each outer blank 25 with respect to the feed direction and therefore in all the points of the packing path P3 each outer blank 25 always has its transverse fold lines 31 parallel to the feed direction (and thus their own longitudinal fold lines 30 perpendicular to the feed direction). Always maintaining a constant orientation of each outer blank 25 along the packing path P3 allows to simplify both the folding operations and the structure of the packing conveyor 68.

Figure 19:
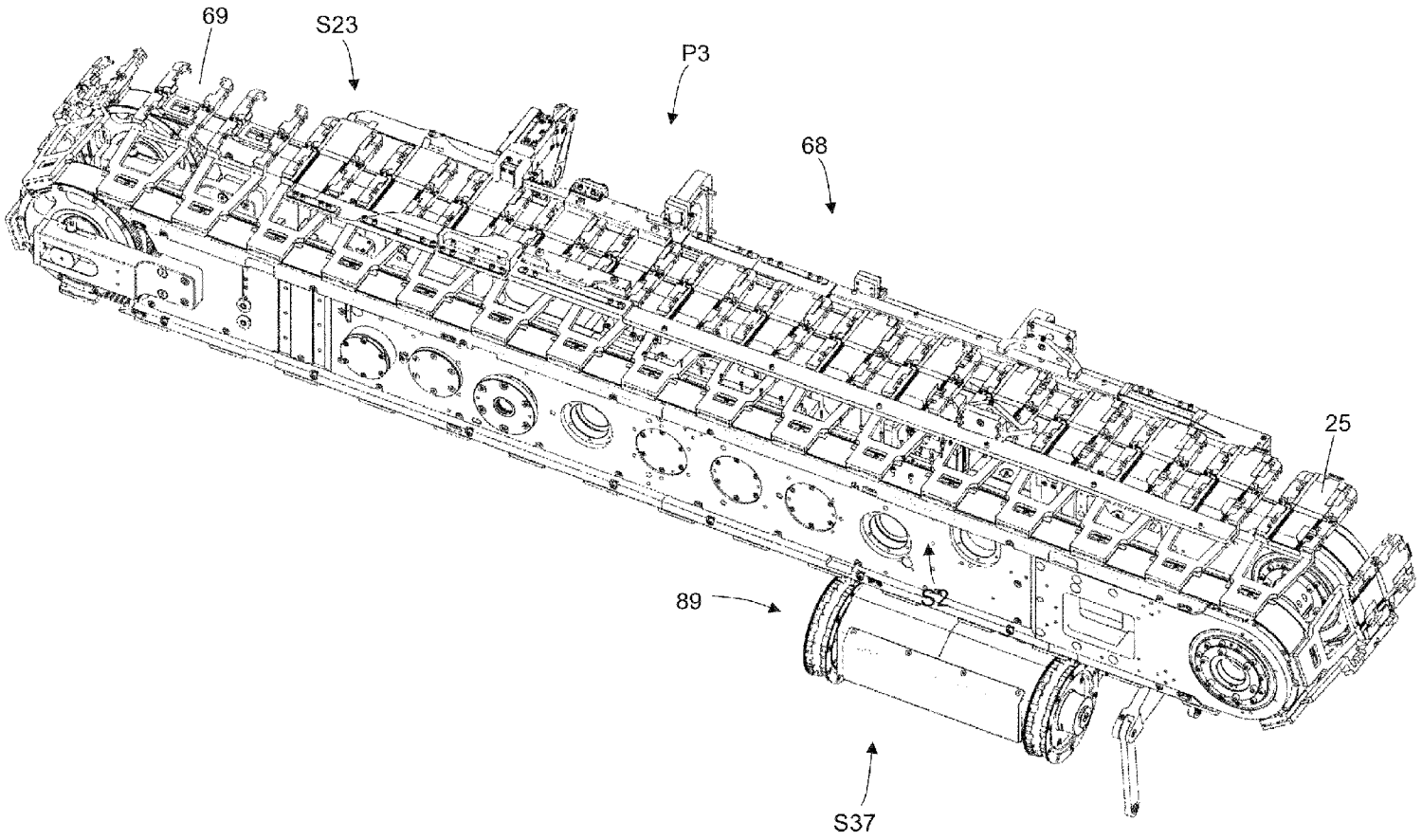
FIG. 19 is a perspective view and with the removal of parts for clarity of the first packing conveyor of FIG. 17.

According to a preferred embodiment shown in FIG. 19, the packing conveyor 68 is constituted by a conveyor belt that is wrapped about two end pulleys and supports a number of packing pockets 69; accordingly, the packing path P3 has a "U" shape and extends between the input station S23 arranged along an initial portion of the rectilinear packing path P3 and the output station S37 arranged along a final portion of the rectilinear packing path P3 that is connected to the initial straight portion by way of an intermediate semicircular portion.

As illustrated in FIG. 17, between the input station S23 and the work station S24 a gumming device 70 (typically provided with gumming nozzles that spray glue) is provided which deposits glue points 71 (illustrated in FIG. 18) on the panel 17' and on the panel 18'.

Between the work station S24 and the work station S26 a folding device 72 is provided having fixed folding profiles (i.e. folding helixes that are devoid of movable parts and perform the folding operation while the outer blank 25 moves in the packing path P3 and thus exploiting the feeding movement of the outer blank 25); the folding device 72 folds the panel 17" by 180°, with respect to the panel 17', about a corresponding transverse fold line 31, and onto the panel 17' itself (to which is glued by the effect of the glue 71), and the folding device 72 folds the panel 18" by 180°, with respect to the panel 18', about a corresponding transverse fold line 31, and onto the panel 18' itself (to which is glued by the effect of the glue 71). Furthermore, the folding device 72 folds the bottom portion 23 of the connecting tab 20 by 180°, with respect to panel 18', about a corresponding transverse fold line 31 in one direction and then in the opposite direction so that at the end of the folding device 72 the bottom portion 23 of the connecting tab 20 is again coplanar with the panel 18'. The folding device 72 performs two opposite folding operations (i.e. that cancel each other) on the bottom portion 23 of the connecting tab 20 having a flex function (or weakening to considerably reduce the residual spring back force) the outer blank 25 along the corresponding transverse fold line 31. Therefore, the function of the folding device 72 is not performing an actual folding of the bottom portion 23 of the connecting tab 20, but preparing the bottom portion 23 of the connecting tab 20 to the successive folding operations (described below).

Between the work station S27 and the work station S29 a folding device 73 is provided having fixed folding profiles (i.e. folding helixes that are devoid of movable parts and perform the folding operation while the outer blank 25 moves in the packing path P3 and thus exploiting the feeding movement of the outer blank 25); the folding device 73 folds the top portion 22 by 90°, of the connecting tab 20, about a corresponding transverse fold line 31, with respect to the bottom portion 23 of the connecting tab 20 in one direction and then in the opposite direction so that at the end of the folding device 73 the top portion 22 of the connecting tab 20 is again coplanar with the bottom portion 23 of the connecting tab 20. The folding device 73 performs two opposite folding operations (i.e. that cancel each other) having a flex function (or weakening to considerably reduce the residual spring back force) the top portion 22 of the connecting tab 20 along the corresponding transverse fold line 31. Therefore, the function of the folding device 73 is not to perform an effective folding of the top portion 22 of the connecting tab 20, but to prepare the top portion 22 of the connecting tab 20 to the successive folding operations (described below).

In the work station S30 a gumming device 74 (typically provided with gumming nozzles that spray glue) is provided which deposits glue points 75 (illustrated in FIG. 18) on the panel 17' and on the panel 18'.

In the work station S31 a folding device 76 is provided having movable parts (i.e. parts that move to perform the folding operation while the outer blank 25 is stopped waiting in the work station S31); the folding device 76 folds the reinforcing' tabs 33 by 90°, with respect to the corresponding panels 17' and 18' and about a corresponding longitudinal fold line 30.

In the work station S32 a folding device 77 is provided having fixed folding profiles (i.e. folding helixes that are devoid of movable parts and perform the folding operation while the outer blank 25 moves in the packing path P3 and thus exploiting the feeding movement of the outer blank 25); the folding device 77 folds the reinforcing tabs 33 by further 90°, with respect to the corresponding panels 17' and 18' and about a corresponding longitudinal fold line 30 so as to rest the reinforcing tabs 33 onto the corresponding panels 17' and 18' (to which the reinforcing tabs 33 are glued by the effect of the glue 75).

In the work station S34 a gumming device 78 is provided (typically provided with a gumming nozzle that sprays the glue) which deposits a strip, of glue 79 (shown in FIG. 18) on the top portion 22 of the connecting tab 20. The glue 79 is a "pressure sensitive glue" and does not dry, or even after a long time from the instant of deposit the glue 79 maintains its characteristics, in other words, the glue 79 is a pressure sensitive glue that is activated by simple pressure without the need for solvents, water or heat. Thanks to the use of pressure sensitive glue 79 that does not dry, the glue 79 can be deposited at a certain distance from the point where the blank 25 is effectively coupled to the inner container 3; in this way, the gumming device 78 can be arranged in an area wherein the outer blank 25 is still substantially flat and the connecting tab 20 is easily accessible and thus able to be gummed. Consequently, the deposit of the glue 79 on connecting tab 20 is extremely simple and effective and is obtained by a gumming device 78 simple and easy to manufacture and assembly in the packing machine 34. This result is obtained thanks to the fact that the glue 79 instead of being a traditional glue that dries (and therefore must be deposited immediately prior to its use) is a repositionable glue that does not dry simultaneously which allows to have an immediate grip and to be applied in any position (does not ever dry, then, theoretically, may be deposited on the outer blank 25 even days before folding the outer blank 25 itself).

As illustrated in FIG. 16, the packing unit 37 comprises a packing conveyor 80 that is provided with a number of packing pockets 81 (illustrated schematically in FIG. 20), each of which is adapted to house an outer blank 25 and a corresponding inner container 3 for feeding the outer blank 25 and the inner container 3 along a packing path P4 that extends between an input station S38 and an output station S40.

At the input station S38, an outer blank 25 partially pre-folded and coming from the packing conveyor 68 is fed into a packing pocket 81 causing a further folding of the outer blank 25 itself. At a feed station S39 arranged between the input station S38 and the output station S40, an inner container 3 is fed into a packing pocket 81 to be coupled to the outer blank 25 previously fed; in particular, in the feed station S39 the rear wall 10 of the container 3 rests on the panel 18' of the outer blank 25. At the output station S40, the outer container 4 (formed by folding the outer blank 25 about the inner container 3) is extracted from the packing pocket 81 and proceeds towards the outlet of the packing unit 37 (i.e., towards the outlet of the packing machine 34).

Figure 20:
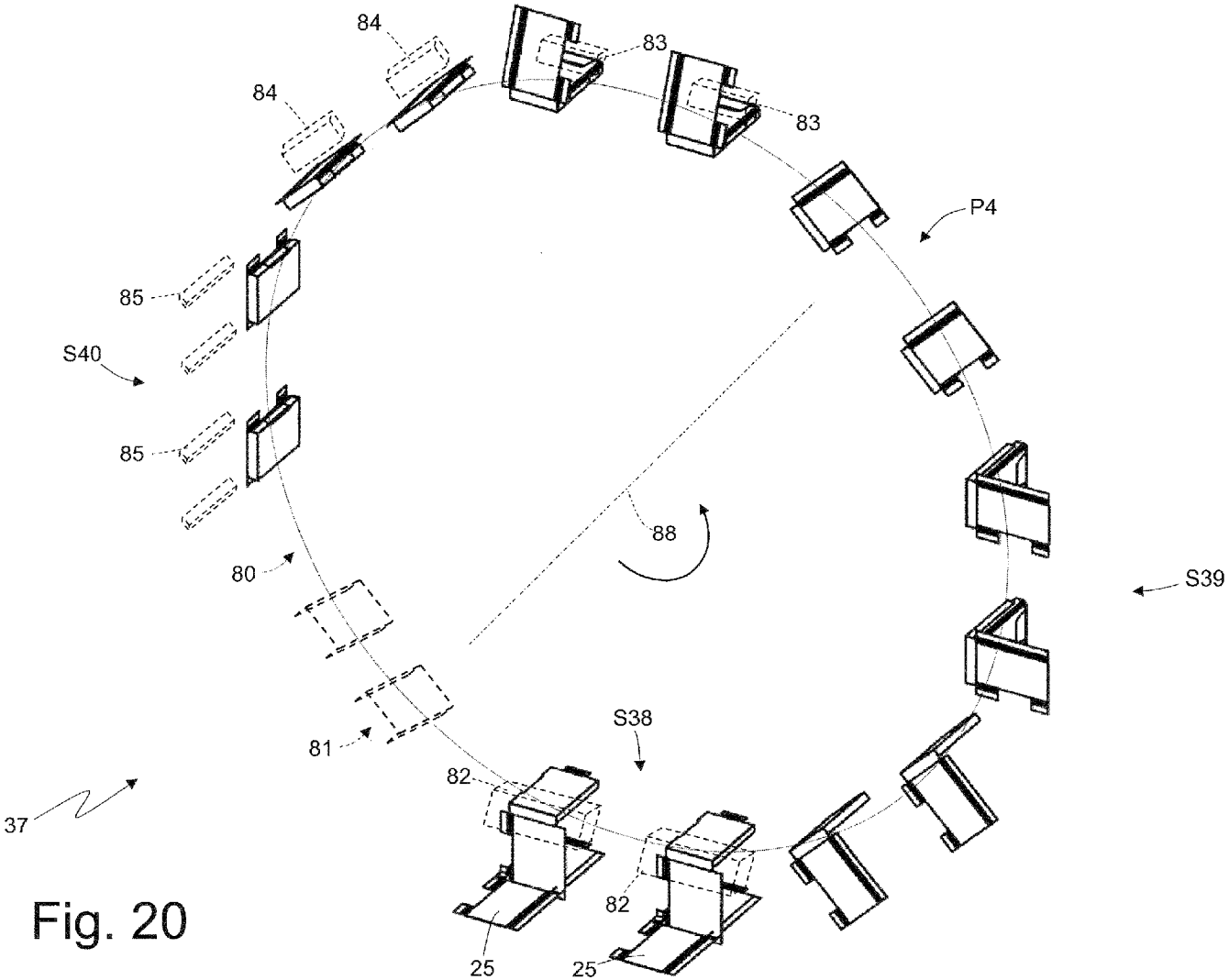
FIG. 20 is a schematic perspective view of a second packing conveyor of the second packing unit of FIG. 16.

As illustrated in FIG. 20, in the input station S38 a folding device 82 is arranged, which folds the tabs 32 of the outer blank 25 by 90°, with respect to the wings 19", and then, by inserting the outer blank 25 into the packing pocket 81, determines the folding of the panel 15' by 90°, with respect to the panel 18' and the folding of the two wings 19" by 90°, with respect to the panel 18'; in other words, after the folding of the tabs 32 by 90°, the input of the outer blank 25 into the packing pocket 81 determines the folding by 90°, of the panel 15', and of the two wings 19" by 90°, with respect to the panel. 18', and in this way the tabs 32 rest on the panel 15'.

Figure 21:
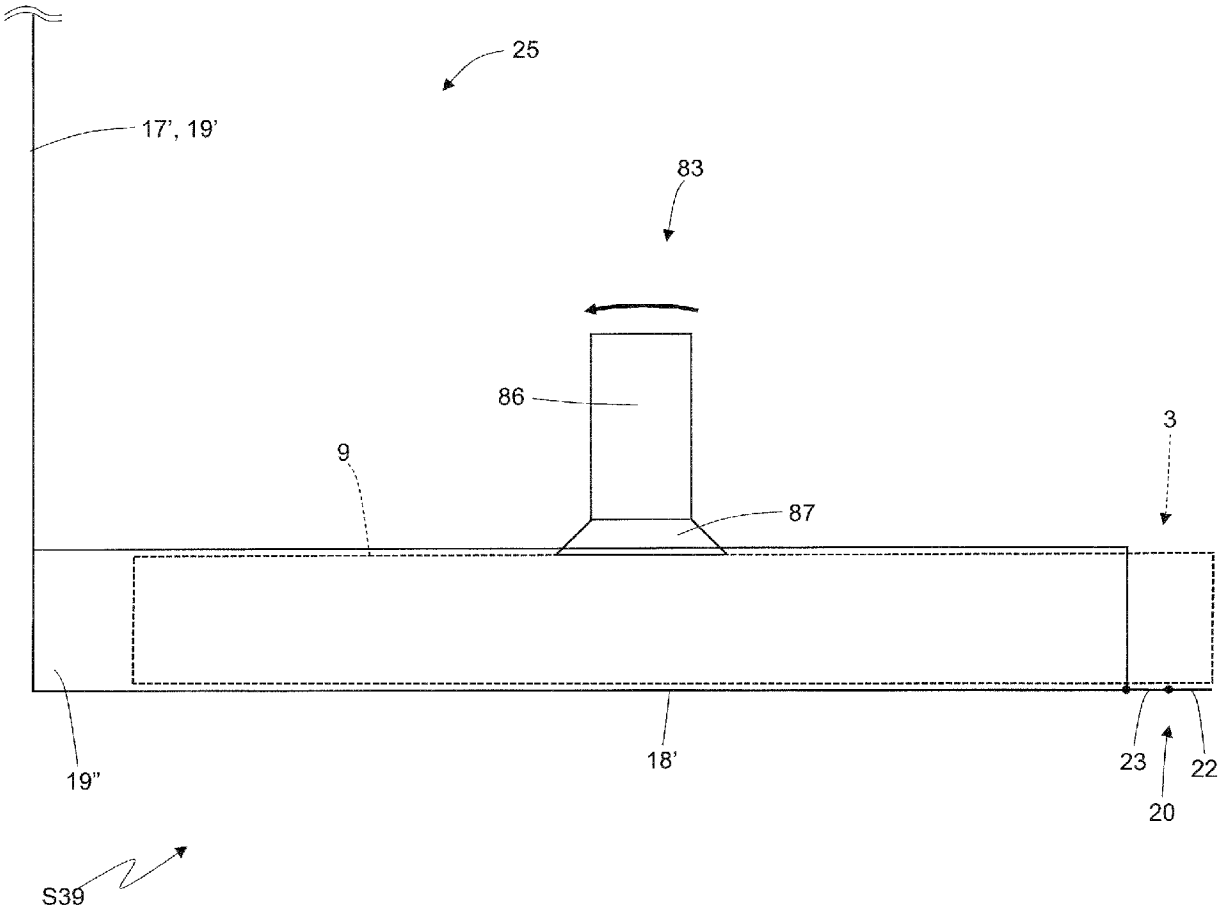
FIGS. 21 and 22 are two side and schematic views of a step of the folding sequence of the outer blank of FIG. 7 in the second packing conveyor of FIG. 20.
Figure 22:
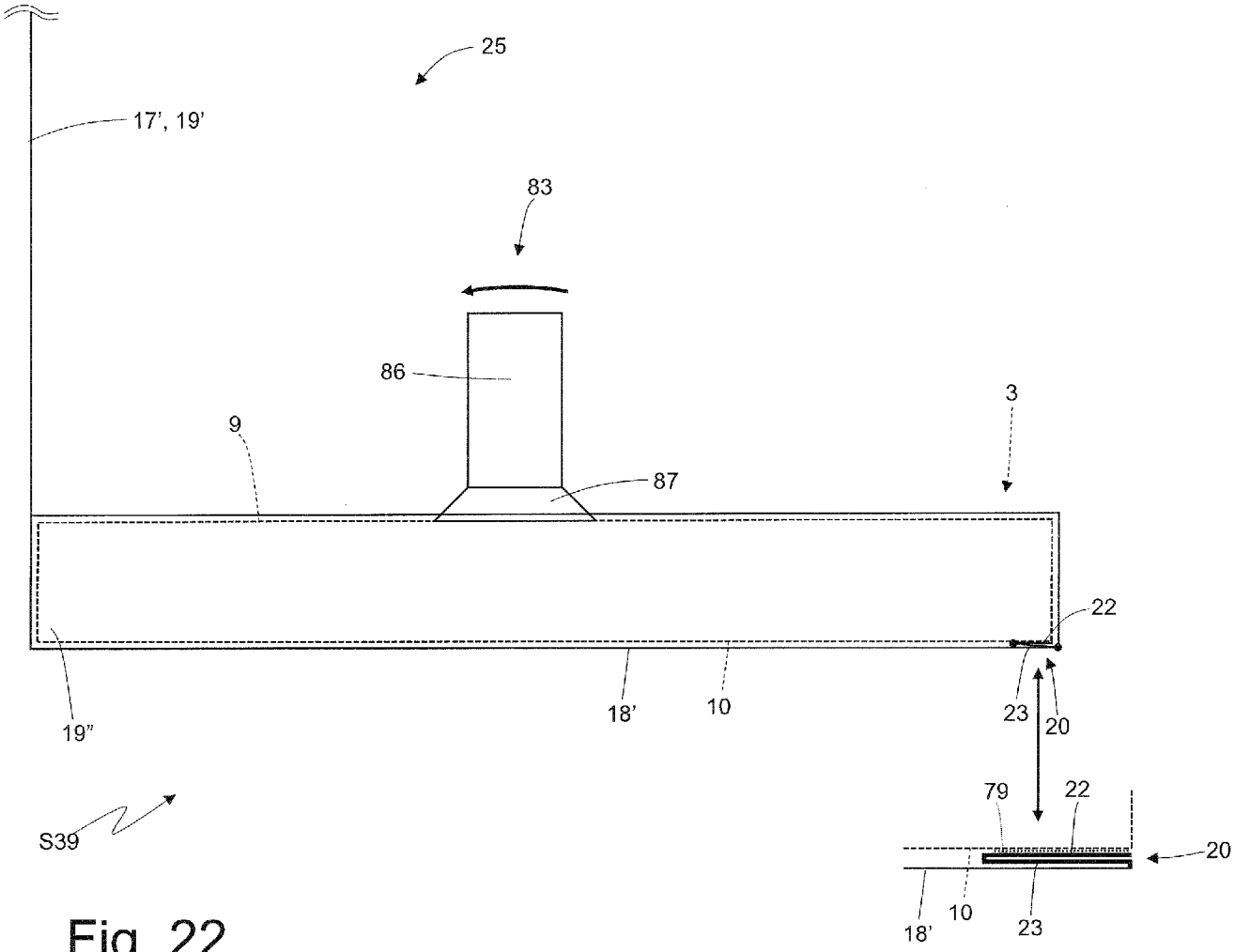

Between the feed station S39 and the output station S40 a folding device 83 is arranged, which folds the connecting tab 20 of the outer blank 25 upon itself, giving the connecting tab 20 itself a "V" shape (schematically illustrated in FIG. 22). In other words, up to the folding device 83 the connecting tab 20 is flat (as shown in FIG. 21), i.e. the top portion 22 and bottom portion 23 of the connecting tab 20 are coplanar one with respect to the other and arranged side by side and are coplanar with the panel 18'; the folding device 83 folds upon itself the connecting tab 20 in order to rest the bottom portion 23 of the connecting tab 20 on the panel 18' and to rest the top portion 22 of the connecting tab 20 to the bottom portion 23 of the connecting tab 20 (as shown in FIG. 22). Arranged downstream from the folding device 83 a further folding device 84 is provided, which folds the panel 17' by 90°, with respect to the panel 15' and about a corresponding transverse fold line 31. The folding of the outer blank 25 is completed in the output station S40 simultaneously with the extraction of the outer container 4 from the packing pocket 81: during the extraction of the outer container 4 from the packing pocket 81 a folding device 85 folds by 90°, the wings 19' with respect to the panel 17', onto the wings 19" and about corresponding longitudinal fold lines 30, completing the formation of the lateral walls 19 of the outer container 4; preferably, a gumming device (not shown) is arranged immediately upstream of the folding device for depositing the glue between the wings 19' and 19" immediately before the folding of the wings 19'. Downstream from the output station S40=a drying conveyor (shown schematically in FIG. 8) is arranged that transfers the packages 1 of cigarettes (each of which is constituted by an outer container 4 containing an inner container 3) towards an outlet of the packing machine 34.

As shown in FIG. 21, in the station S39 each inner container 3 rests on the connecting tab 20 (to which is glued by the effect of the glue 79) while the connecting tab 20 is fully extended (i.e. at a position corresponding to a condition of partial extraction of the inner container 3 from the outer container 4). Subsequently and as illustrated in FIG. 22, each inner container 3 is moved with respect to the outer blank 25 to arrange the inner container 3 in a position corresponding to the closed position wherein the inner container 3 is inserted in the outer container 4 determining a subsequent folding of the connecting tab 20. The displacement of each inner container 3 with respect to the outer blank 25 to determine the folding of the connecting tab 20 is performed by the folding device 83 that comprises an actuator member 86 (shown in FIGS. 21 and 22) that rests on the front wall 9 of the inner container 3 and is movable in two directions perpendicular one to the other (in particular, the actuator member 86 is able to translate both perpendicular to the front wall 9 of the inner container 3, and parallel to the front wall 9 of the inner container 3) to perform the rotation of the bottom portion 23 of the connecting tab 20 by 180°, with respect to the panel 18' and about a corresponding transverse fold line 31. The actuator member 86 is provided with a suction head 87 wherein the suction can be activated/deactivated.

When a packing pocket 81 carrying an outer blank 25 and a respective inner container 3 arrives in correspondence of the folding device 83, the actuator member 86 is moved towards the inner container 3 so as to come in contact with the front wall 9 of the inner container 3 itself. When the actuator member 86 has come in contact with the front wall 9 of the inner container 3 the suction through the suction head 87 is activated so as to establish a mechanical constraint (generated by the suction force) between the suction head 87 and the front wall 9 of the inner container 3.

Once the suction through the suction head 87 is activated, the actuator member 86 moves to move along with itself the inner container 3 with respect to the outer blank 25, and then determine the folding of the connecting tab 20; as mentioned previously, the actuator member 86 is movable in two directions perpendicular one with respect to the other to perform the rotation of the bottom portion 23 of the connecting tab 20 by 180°, with respect to the panel 18' and about a corresponding transverse fold line 31; in this way, the connecting tab 20 is folded without applying any mechanical tension to the connecting tab 20 and therefore avoiding any kind of breakage or undesirable deformation of the mechanical connection between the top portion 22 of the connecting tab 20 and the rear wall 13 of the lid 6 determined by the glue 79. In other words, the force that is transmitted through the connecting tab 20 during the displacement of the inner container 3 (i.e. during the folding of the connecting tab 20 itself) is very low if not zero (due to the pre-flexing performed by the folding device 72 on the bottom portion 23 of the connecting tab 20) and therefore the displacement of the inner container 3 can be performed very quickly without any risk of damaging, even in a slight way, the gluing between the connecting tab 20 and the rear wall 13 of the lid 6.

According to a preferred, embodiment illustrated in the attached figures, the packing conveyor 80 is constituted by a rotating wheel which rotates by steps about a horizontally arranged central axis of rotation 88. Consequently, the packing path P4 that extends from the input station S38 to the output station S40 has a circular shape.

As illustrated in FIG. 16, the packing unit 37 comprises a transfer conveyor 89 which transfers the pre-folded outer blanks 25 from the output station S37 of the packing conveyor 68 to the input station S38 of the packing conveyor 80. Along the transfer conveyor 89 and upstream from the input station S38 of the packing conveyor 80 a gumming device 90 is arranged which deposits glue between the tabs 32 and the panel 15' of the outer blank 25.

According to a preferred embodiment, an outer blank 25 at a time is fed to the packing conveyor 68 in the input station S23 of the packing path P3, and the transfer conveyor 89 transfers two outer blanks 25 at a time from the packing conveyor 68 to the packing conveyor 80; in this embodiment, the packing conveyor 80 treats at each step two outer blanks at a time. According to an alternative embodiment not illustrated, two outer blanks 25 at a time are fed to the packing conveyor 68 in the input station S23 of the packing path P3.

The packing method and the corresponding packing machine 34 described above have many advantages, as they allow to produce the slide-open packages 1 with a hinged lid with high productivity (i.e. with a high number of packages 1 of cigarettes produced per unit of time) while maintaining a high quality standard. This result is obtained thanks to the conformation of the packing units 36 that by completing the formation of the lid 6 in the packing conveyor 41 (i.e. before coupling the inner blank 24 to the wrapped group 2 of cigarettes) allows to form the lid 6 in a simple and effective way and simultaneously allows to greatly simplify the folding of the inner blank 24 about the wrapped group 2 of cigarettes. In particular, the formation of the lid 6 is easier (and therefore simple and fast) along a straight packing path (as, indeed, is the packing path P1 of the packing conveyor 41), while the folding of the inner blank 24 about the wrapped group 2 of cigarettes is easier (and therefore simple and fast) along a circular packing path (as, indeed, is the packing path P2 of the packing conveyor 58). So, thanks to the conformation of the packing units 36 all the folding operations can be performed in the most favorable situation, and therefore can be performed quickly (i.e. with a high productivity of the packing process) while ensuring a high quality standard.

Additionally, but not less important, the packing method and the corresponding packing machine 34 described above are extremely "flexible", i.e. allow to vary quickly and simply the type of slide-open packages 1 of cigarettes that are produced (with the hinged lid 6 comprised in the inner blank or comprised in the outer blank 25 or without a hinged lid). Among other things, the high flexibility is provided by the fact that in each packing unit 36 or 37 there is a first packing conveyor 41 or 68 wherein a preliminary folding of the inner blank 24 or outer blank 25 is performed and a second packing conveyor 58 or 80 wherein the preliminary folding of the inner blank 24 or outer blank 25 is completed; in fact, thanks to the presence of the first packing conveyor 41 or 68 it is relatively simple to perform the preliminary folding of the inner blank 24 or outer blank 25 to form a lid, and once the lid is formed the final folding of the inner blank 24 or outer blank 25 is "conventional" (i.e. analogous to the folding of a standard blank) and therefore devoid of particular complications.

It is important to observe that the two packing units 36 and 37 are very similar to each other: both packing units 36 and 37 have the same structure that comprises a first packing conveyor (the packing conveyors 41 and 68) consisting in a conveyor belt and intended to produce a preliminary folding of the blank, a second packing conveyor (the packing conveyors 58 and 80) consisting in a wheel and intended to fold the blank (already partially folded) about the content, and a transfer conveyor (the transfer conveyors 66 and 89) that connects the two packing conveyors. Furthermore, the two second packing conveyors (the packing conveyors 58 and 80) of the two packing units 36 and 37 perform almost all the packing operations in the same way and in the same areas. Finally, the two packing units 36 and 37 can share between one another a large number of components, i.e. the same identical component is frequently present in both packing units 36 and 37 (in particular, the two packing units 36 and 37 can have in common at least 70-80% of the components); in this way, it is possible to break down in a very significant way the production, assembly and maintenance cost of the packing machine 34.

Finally, it is important to observe that the connecting tab 20 remains always fully extended until the feed station S39, wherein the inner container 3 is coupled to the outer blank 25 by resting the rear wall 13 of the lid 6 of the inner container 3 to the gummed portion 22 of the connecting tab 20 while the connecting tab 20 is fully extended; in fact, the connecting tab 20 is folded upon itself only successively by moving by means of the folding device 83, the inner container 3 with respect to the outer blank 25 and towards a position corresponding to a fully closed position of the package 1. In this way, the outer blank 25 is more easily conveyable towards the feed station S39, since along the path towards the feed station S39 the outer blank 25 is devoid of folded parts and not locked in the folded configuration by points of glue; in other words, the pre-folded shape of the outer blank 25 which is conveyed to the feed station S39 is stable, and then the conveyance of the outer blank 25 towards the feed station S39 can take place without special precautions. This condition is particularly advantageous in the packing unit 37 described above, wherein the conveying path of the outer blank 25 towards the feed station S39 is particularly long and has a complex shape (i.e., with several changes of direction).

The invention claimed is:

1. A packing method for producing a slide-open package of tobacco articles with a hinged lid; the packing method comprising the steps of:

forming a wrapped group of tobacco articles by means of a first packing unit;

forming, by means of a second packing unit and by folding an inner blank about the wrapped group of tobacco articles, an inner container housing the wrapped group of tobacco articles and having the hinged lid; and forming, by means of a third packing unit and by folding an outer blank about the inner container, an outer container, which slidably houses the inner container, and has a connecting tab integral at one end with the outer container and glued at the other end to the lid of the inner container;

wherein the step of forming the outer container comprises the further steps of:

depositing glue on a portion of the connecting tab by means of a gumming device, while the connecting tab is fully extended;

coupling the inner container to the outer blank at a feed station, so that a wall of the lid of the inner container rests on the gummed portion of the connecting tab while the connecting tab is fully extended; and moving, by means of a folding device, the inner container, with respect to the outer blank and towards a position corresponding to a fully closed position of the package, in which the inner container is fully inserted inside the outer container, so as to fold on itself the connecting tab; and wherein the folding device comprises an actuator, which rests on a front wall of the inner container, and is movable in two directions perpendicular one with respect to the other to perform the rotation of a bottom portion of the connecting tab with respect to a second panel of the outer blank, corresponding to a rear wall of the outer container, and about a corresponding transverse fold line.

2. The packing method according to claim 1, and further comprising:

starting the folding of the outer blank upstream from the feed station, before coupling the inner container to the outer blank; and completing the folding of the outer blank about the inner container downstream from the folding device.

3. The packing method according to claim 1, and further comprising:

folding a first panel of the outer blank, corresponding to a bottom wall of the outer container by 90°, with respect to a second panel of the outer blank, corresponding to a rear wall of the outer container, upstream from the feed station;

folding two first wings of the outer blank, corresponding to respective lateral walls of the outer container by 90°, with respect to the second panel of the outer blank, upstream from the feed station; and resting the inner container onto the second panel of the outer blank at the feed station.

4. The packing method according to claim 3, further comprising:

folding a third panel of the outer blank, corresponding to a front wall of the outer container by 90°, with respect to the first panel of the outer blank and onto a front wall of the inner container, downstream from the folding device; and folding two second wings of the outer blank, corresponding to the respective lateral walls of the outer container by 90°, with respect to the third panel of the outer blank and onto the previously folded first wings, downstream from the folding device.

5. The packing method according to claim 1, wherein the glue applied to the portion of the connecting tab is non-dry, re-stick glue.

6. The packing method according to claim 1, wherein the folding device folds in on itself the connecting tab of the outer blank into a V-shape, in which a gummed top portion of the connecting tab is superimposed on a bottom portion of the connecting tab, and the bottom portion of the connecting tab rests on a second panel of the outer blank corresponding to a rear wall of the outer container.

7. The packing method according to claim 6, wherein, up to the folding device, the connecting tab is flat, that is the top portion and the bottom portion of the connecting tab are coplanar one with respect to the other and side by side, and are coplanar with the second panel of the outer blank.

8. The packing method according to claim 1, wherein the actuator has a suction head, in which suction can be activated/deactivated to form a mechanical constraint between the suction head and the front wall of the inner container.

9. A packing machine for producing a slide-open package of tobacco articles with a hinged lid; the packing machine comprising:

a first packing unit for forming a wrapped group of tobacco articles;

a second packing unit for forming, by folding an inner blank about the wrapped group of tobacco articles, an inner container housing the wrapped group of tobacco articles and having the hinged lid; and a third packing unit for forming, by folding an outer blank about the inner container, an outer container, which slidably houses the inner container, and has a connecting tab integral at one end with the outer container and glued at the other end to the lid of the inner container;

wherein the third packing unit comprises:

a gumming device for depositing glue on a portion of the connecting tab, while the connecting tab is fully extended;

a feed station for coupling the inner container to the outer blank, so that a wall of the lid of the inner container rests on the gummed portion of the connecting tab while the connecting tab is fully extended; and a folding device for moving the inner container, with respect to the outer blank and towards a position corresponding to a fully closed position of the package, in which the inner container is fully inserted inside the outer container, so as to fold upon itself the connecting tab; and wherein the folding device comprises an actuator, which rests on a front wall of the inner container, and is movable in two directions perpendicular one with respect to the other to perform the rotation of a bottom portion of the connecting tab with respect to a second panel of the outer blank, corresponding to a rear wall of the outer container, and about a corresponding transverse fold line.

* * * * *